US006928914B2

(12) United States Patent
Marsh

(10) Patent No.: US 6,928,914 B2
(45) Date of Patent: Aug. 16, 2005

(54) BOOK TRIMMING APPARATUS AND METHOD

(76) Inventor: Jeffrey D. Marsh, 7 Country Rd., Foristell, MO (US) 63348

( * ) Notice: Subject to any disclaimer, the term of this patent is extended or adjusted under 35 U.S.C. 154(b) by 181 days.

(21) Appl. No.: 09/960,148

(22) Filed: Sep. 20, 2001

(65) Prior Publication Data

US 2002/0034428 A1 Mar. 21, 2002

Related U.S. Application Data

(60) Provisional application No. 60/235,411, filed on Sep. 21, 2000.

(51) Int. Cl.[7] ..... B26D 5/42; B26D 7/18

(52) U.S. Cl. ..... 83/414; 83/206; 83/220; 83/227; 83/277

(58) Field of Search ..... 83/934, 219, 220, 83/206, 414, 225, 227, 277, 704, 705

(56) References Cited

U.S. PATENT DOCUMENTS

| | | | | | |
|---|---|---|---|---|---|
| 1,003,679 | A | | 9/1911 | Welch | 83/255 |
| 1,076,726 | A | | 10/1913 | Welch | 83/255 |
| 1,088,573 | A | | 2/1914 | Heldmann | 83/409.2 |
| 1,757,623 | A | | 5/1930 | Frazier | 83/203 |
| 3,546,990 | A | * | 12/1970 | Schneider et al. | 83/27 |
| 3,559,516 | A | | 2/1971 | Freeman | |
| 3,570,344 | A | | 3/1971 | Bryson et al. | |
| 3,633,727 | A | | 1/1972 | Brenner | 198/412 |
| 3,822,626 | A | * | 7/1974 | Aspinwall | 83/934 X |
| 3,888,150 | A | | 6/1975 | Stroud et al. | 83/368 |
| 3,913,750 | A | | 10/1975 | Sarring | |
| RE28,840 | E | | 6/1976 | Sarring | |
| 3,965,781 | A | | 6/1976 | Stroud et al. | |
| 4,436,469 | A | | 3/1984 | Kelly | 412/16 |
| 4,445,407 | A | | 5/1984 | Lucas | |
| 4,484,501 | A | | 11/1984 | Ramcke | 83/255 |
| 4,507,037 | A | | 3/1985 | Fenimore | |
| 4,518,157 | A | | 5/1985 | Stobb | 270/52.17 |
| 4,606,387 | A | | 8/1986 | Weoslogel et al. | 144/356 |
| 4,621,552 | A | * | 11/1986 | Lopez | 83/277 X |
| 4,922,773 | A | | 5/1990 | Ito | 83/76.6 |
| 5,009,138 | A | | 4/1991 | Rettie | 83/413 |
| 5,259,285 | A | | 11/1993 | Uchida | 83/620 |
| 5,279,196 | A | * | 1/1994 | Mohr | 83/934 X |
| 5,377,569 | A | * | 1/1995 | Richards et al. | 83/934 X |
| 5,632,587 | A | | 5/1997 | Coyette | 412/11 |
| 5,660,515 | A | | 8/1997 | Hartsoe | 412/1 |
| 5,694,823 | A | | 12/1997 | Westra et al. | 83/147 |
| 5,850,774 | A | | 12/1998 | Naldi | 83/418 |
| 5,904,084 | A | | 5/1999 | Weston | 83/373 |
| 6,193,458 | B1 | | 2/2001 | Marsh | |
| 6,516,695 | B2 | * | 2/2003 | Cassoni et al. | 83/227 X |

OTHER PUBLICATIONS

DocuTrim™ Challenge; The Challenge Machinery Company.

* cited by examiner

*Primary Examiner*—Charles Goodman
(74) *Attorney, Agent, or Firm*—Polster, Lieder, Woodruff & Lucchesi

(57) ABSTRACT

A trimmer (1) is disclosed from trimming excess margins (M) along one, two or three edges of a perfect bound book (B) is disclosed. The trimmer has a shearing blade (15) movable in a shearing plane (SP) between an open and a closed position. The book is gripped by a book holder (35) proximate the spine (S) of the book and the book holder is vertically positioned such the shear blade will shear the book in a predetermined position along this first edge of the book. The book holder is then moved transversely with respect to the blade and the book is rotated 180° and the book holder is vertically positioned so that a predetermined amount of the margin along this second edge is trimmed from the book upon closing of the shear blade. The book is then moved transversely to a third position and the book is rotated 90° and the book holder is vertically positioned so that a predetermined amount of the margin along this third edge is trimmed from the book upon closing of the shear blade. A method of trimming perfect bound books is also disclosed.

38 Claims, 15 Drawing Sheets

FIRST POSITION

SECOND POSITION

THIRD POSITION

BOOK TRIMMING APPARATUS AND METHOD

CROSS REFERENCE TO RELATED APPLICATION

This application claims priority to U.S. Provisional Patent Application No. 60/235,411, filed Sep. 21, 2000.

BACKGROUND OF THE INVENTION

This invention relates to book trimming apparatus and a method of trimming a book along three edges of a perfect bound book using a single shear or trimming blade where the book is rotated to trim the three edges. Reference may be made to U.S. Pat. No. 5,694,823.

SUMMARY OF THE INVENTION

Among the several objects and features of this invention may be noted the provision of a trimmer for trimming the margins along three edges of a perfect bound book which may be readily adjusted by an operator to trim any book within a range of sizes and thickness;

The provision of such a trimmer in which the operator may readily input the size (height and width) of the book into the control system for the computer, place the book in a book holder, and initiate operation of the trimmer so as to effect the trimming of three edges of the book to a predetermined size;

The provision of such a trimmer which accurately rotates the book as the trimmer moves the book to trim the three edges of the book;

The provision of such a trimmer which has a relatively small footprint so that it takes up a minimum amount of room in a print shop or the like;

The provision of such a trimmer which is easy to insert a book to be trimmed;

The provision of such a trimmer which trims the three edges of the book in a relatively short time; and The provision of such a trimmer which is of rugged construction, which requires little operator training, and which accurately trims the edges of a book to predetermined dimensions.

Briefly stated, a book trimmer of the present invention trims the edges of a perfect bound book to predetermined finished dimensions. The book is made up of a plurality of text pages and a cover with the book being rectangular. The margins of the book are to be trimmed along two of its minor edges and along one of its major edges to predetermined finished dimensions. The trimmer comprises a trimming blade movable between an open position in which the book may be inserted between the blade and a closed position in which the book is sheared between the blade and a platen along a shearing plane. The trimmer comprises a holder for gripping the book as the book is trimmed, and a carriage supporting the holder. The carriage is movable laterally with respect to the blade between a first position in which a first edge of the book may be trimmed, a second position in which a second edge of the book may be trimmed, and a third position in which a third edge of the book may be trimmed. The carriage along with the holder and the book carried by the holder are movable toward and away from the blade so as to position the book with respect to the blade such that the with the carriage in its the first, second and third positions, the first, second and third edges of the book may be accurately positioned with respect to the shearing plane such that predetermined amounts of the book may be trimmed from the first, second and third edges of the book thereby to produce a finished book trimmed to its predetermined finished dimensions.

Further, this invention comprises a method of trimming three edges of a perfect bound book to a predetermined finished size. The perfect bound book has a cover and a plurality of pages with the book being generally rectangular and with the cover and pages being bound to one another along one edge or the spine of the book with the book having top and bottom edges being generally perpendicular to the spine and with an outer edge being generally parallel to the spine. More specifically, the method comprises placing the book to be trimmed in a holder with the bottom edge of the book projecting downwardly and with the book being gripped by the holder proximate the spine. Then moving the book vertically so that a predetermined amount of the book along its bottom edge is positioned for being trimmed from the book. A shear blade is then actuated to move in a generally shearing plane to trim the predetermined amount from the bottom edge of the book. The book is moved from the first position to a second position in which the top edge of the book projects toward the shearing plane. The book is moved so that a predetermined amount of the book along the top edge is positioned for being trimmed from the book The shear blade is actuated to trim the predetermined amount from the top edge of the book. The book is moved from the second position to a third position in which the side edge of the book is positioned so that a predetermined amount of the book along the side edge is positioned for being trimmed from the book. The shear blade is actuated to trim the predetermined amount from the side edge. Then, the trimmed book is released from the trimmer.

Other objects and features of this invention will be in part apparent and in part pointed out hereinafter.

BRIEF DESCRIPTION OF THE DRAWINGS

Corresponding reference characters indicated corresponding parts throughout the several views of the drawings.

DESCRIPTION OF PREFERRED EMBODIMENT

Figure 1:
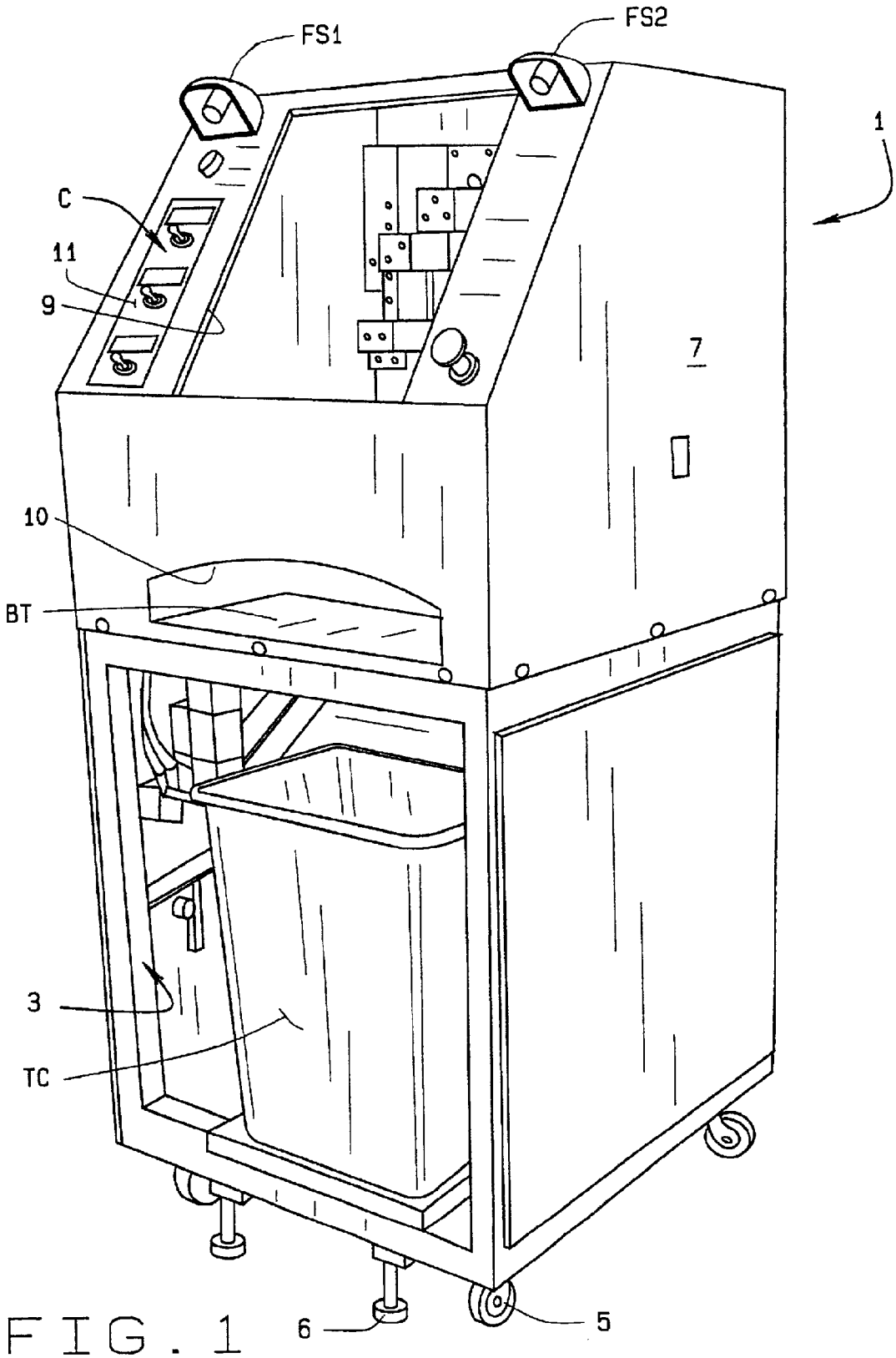
FIG. 1 is a perspective view of the trimmer of the present invention.

Referring now to the drawings, and more particularly to FIG. 1, a book trimming apparatus of the present invention is indicated in its entirety at 1. The book trimmer comprises a frame 3 mounted on casters 5 so that the trimmer may readily be moved to convenient positions for trimming books, as required. Leveling screws 6 are also carried by frame 3 so that with the trimmer in a desired operating position, the leveling screws may be lowered to engage the floor thus solidly supporting the trimmer with respect to the floor. Trimmer 1 is enclosed by a cabinet 7. As indicated at 9, trimmer 1 has a work opening which allows an operator to readily place a book to be trimmed in the apparatus for being trimmed. As shown, work opening 9 is in the upper front portion of the cabinet 7 and the cabinet is provided with controls C for adjusting the finished size of the book to be trimmed and for initiating operation and for emergency stopping of apparatus 1. While controls C are shown to be mounted on control panels 11 on the sides of the work opening 9, it will be understood that within the broader aspects of this invention, such controls may be mounted at a convenient location on the trimmer such that they are readily accessible by the operator. It will also be understood, that the opening 9 may be provided with a light curtain safety switch such that if the operator extends his hand through the opening while the trimmer is in operation, the trimmer will immediately stop. As shown, finger switches FS1 and FS2 are provided at the top of the cabinet. In order to start operation of the trimmer after the book has been installed, the operator must press both of the finger switches at the same time.

Figure 2:
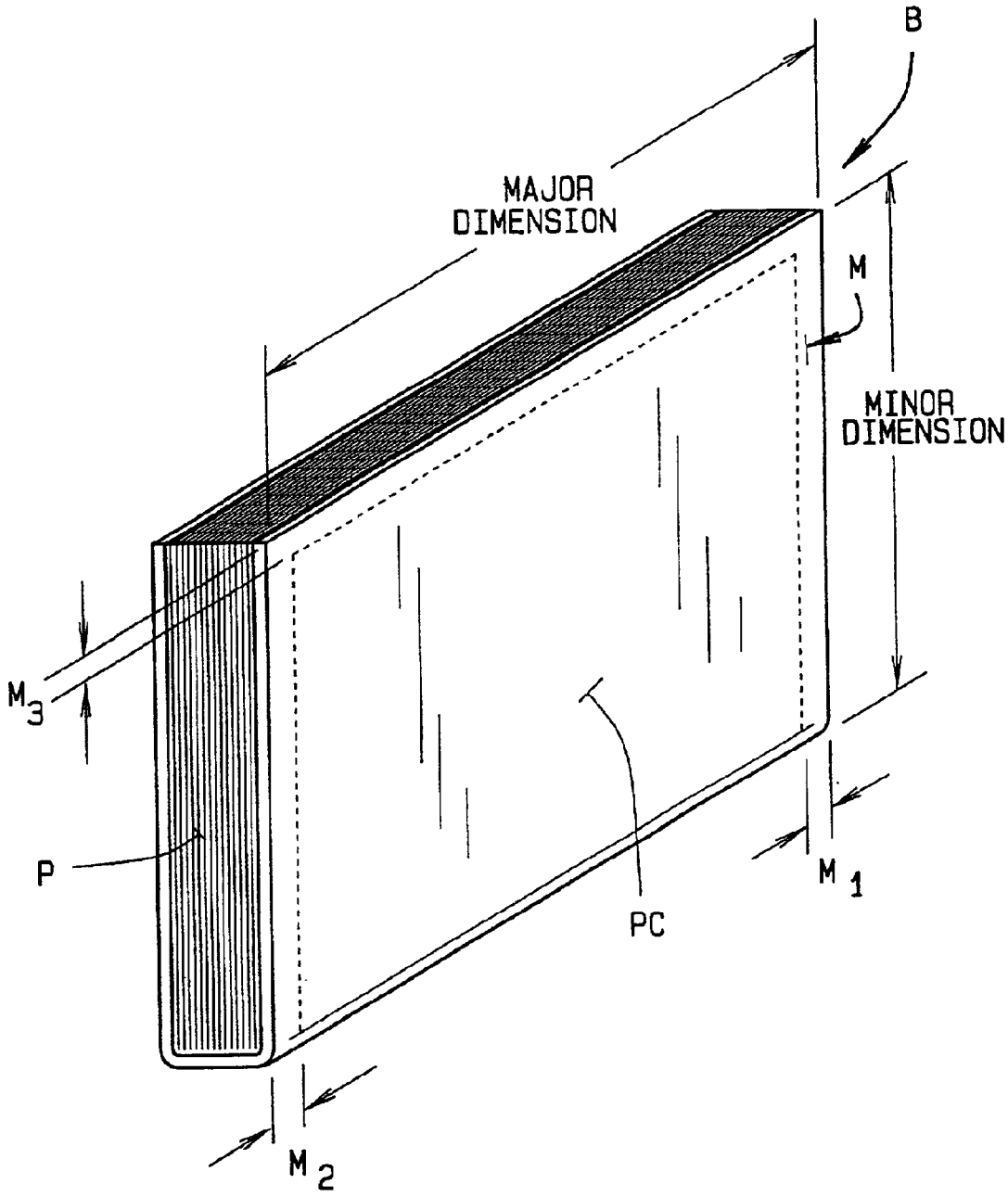
FIG. 2 is a perspective of a perfect bound book to be trimmed by the trimmer of the present invention.

As noted, trimmer 1 is intended to trim the margins M of a perfect bound book B (as shown in FIG. 2) so as to produce a perfect bound book having predetermined finished dimensions. A perfect bound book is a document having a multiplicity of text pages P and a soft paper cover PC which is typically of a substantially thicker (heavier) stock than the text pages. Book B typically (though not necessarily) is of rectangular dimensions having a major dimension (height) and a minor dimension (width). Thus, the book has two minor edges (M1 and M2) and two major edges (M3 and spine S, as hereinafter described). Along one major edge of the book, the text pages P are bonded by a suitable adhesive to one another and to the inner face of the center portion of the cover PC in a manner well known to those skilled in the book binding art. The edge along which the pages are bound to the center portion of the cover is referred to as the spine S of the book. Thus, in order to produce a perfect bound book with uniform edges of predetermined height and width dimensions, the book is printed on stock somewhat larger than the predetermined finished dimensions of the book and the excess margins M of the book along both of the minor edges M1 and M2 and along the major edge M3 opposite spine S are trimmed to predetermined dimensions so as to result in a trimmed or finished book having predetermined major and minor edges. While the trimmer of the present invention is described herein in the context of trimming three edges of a perfect bound book, those skilled in the art will appreciate that trimmer 1 may be used to trim one, two, three or four edges of documents other than books. In the above description of the book, the book is described as being rectangular having major and minor dimensions. However, those skilled in the art will recognize that the trimmer 1 may also be used to trim square shaped books as well as rectangular books. In such cases, the minor edges of the book M1 and M2 are perpendicular to spine S and the major dimension is parallel to the spine.

Figure 3:
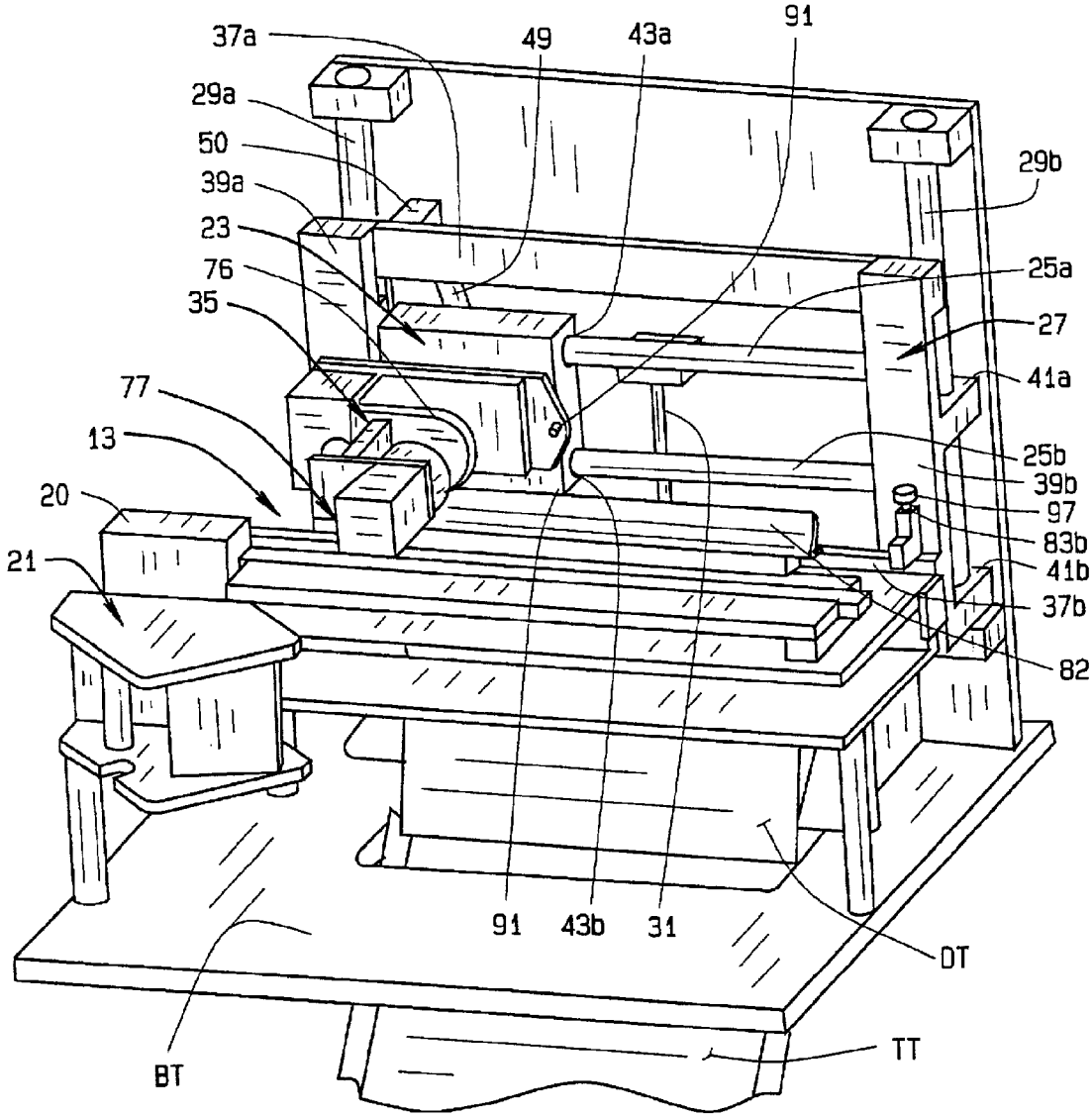
FIG. 3 is a perspective view of the trimmer with the cabinet removed illustrating a shear assembly, a carriage having a holder for holding the book as it is trimmed, and a first embodiment of an indexing mechanism for moving the carriage and the book between first, second and third positions for trimming a predetermined amount of the margins along the first and second minor edges and from one of the major edges of the book, and further illustrating a selectively operable screw jack for accurately adjusting the above mechanism and the book held thereby relative to the shear assembly.
Figure 4:
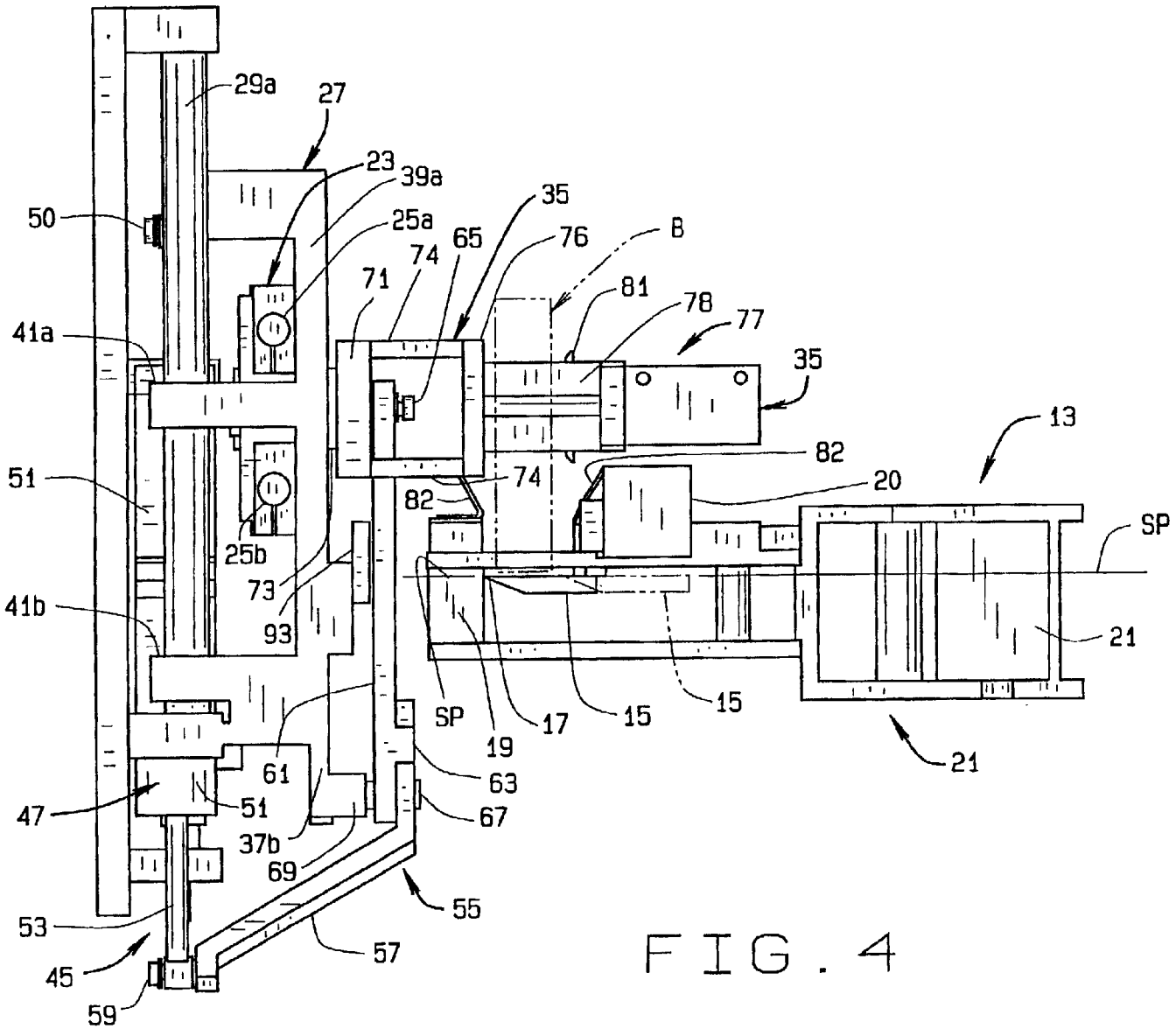
FIG. 4 is a side elevation of the trimmer, as shown in FIG. 3, illustrating a book (shown in phantom) having its lower edge resting on the upper surface of a shear blade thereby to locate the book relative to the shear blade, and illustrating the first embodiment of the indexing mechanism for moving the book between its first, second and third position and for rotating the book so as to trim the edges of the book.
Figure 14:
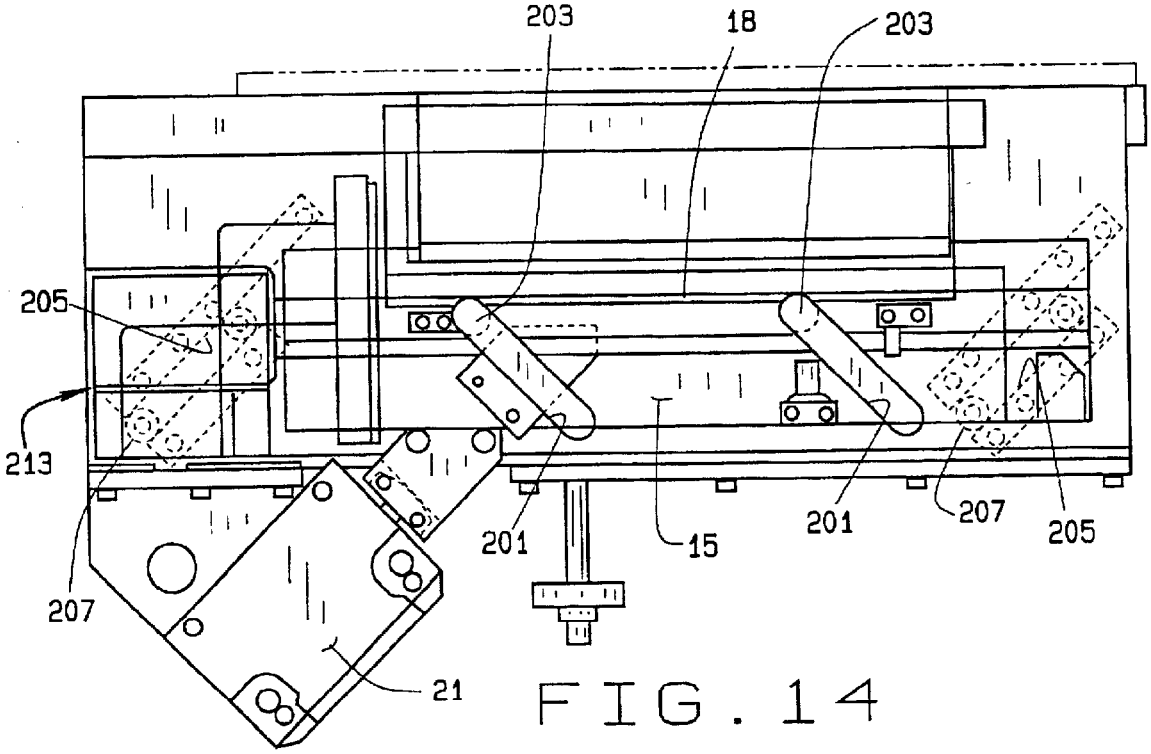
FIG. 14 is a top plan view of the shear assembly.
Figure 15:
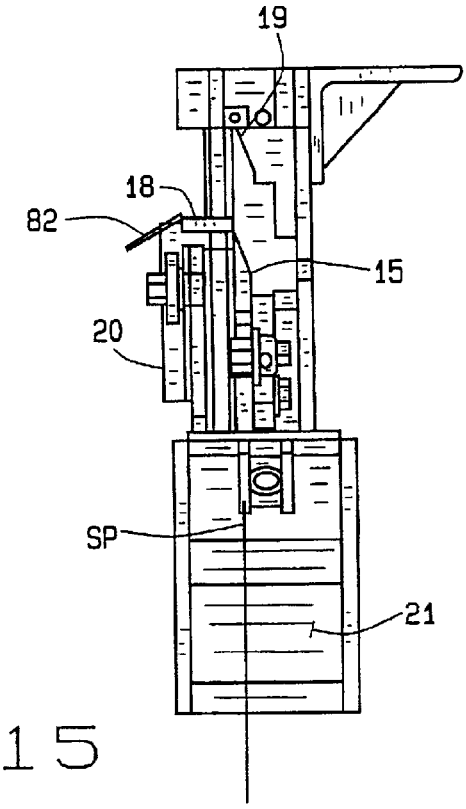
FIG. 15 is an end elevational view of the shear assembly.

As shown in FIGS. 3 and 4, trimmer 1 has a shear blade assembly 13 mounted on frame 3 substantially at the level of the lower edge of work opening 9. The shear assembly has a shear blade 15 which is forcefully movable in horizontal direction defining a shear plane SP (also referred to as a shearing plane) between an open or retracted position (as shown in dotted lines in FIG. 4) in which a book B (or other document) to be trimmed may be positioned between the cutting edge 17 of blade 15 and a stationary shear platen 19 and a closed or trimming position (as shown in solid lines in FIG. 4) in which the cutting edge 17 of blade 15 shears through the cover PC and text pages P of the book along the shearing plane SP. Shear blade 15 is forcefully moved between its open and closed positions by a suitable power drive, such as a hydraulic cylinder 21. Those skilled in the art will appreciate that power drives other than a fluid cylinder may be used to actuate the shear blade. For example, a screw jack or other mechanical drive may be employed. As best shown in FIGS. 14 and 15, shear assembly 13 operates through a plurality of inclined cams and corresponding cam followers that moves (translates) shear blade 15 between its open and closed positions while remaining parallel to stationary shear platen 19. Further, the shear assembly include a book clamp 18 which forcefully holds the book in position against shear platen 19. This clamp is operated by a clamp cylinder 20. Thus, before the book is engaged by shear blade 15 to shear the book, it is clamped with respect to the platen by the clamp and after shearing one edge of the book, the clamp is released to permit the book to be moved to its second and third positions as will be hereinafter described.

FIGS. 14 and 15 illustrate the shear blade assembly 13 previously described. Of course, the reference characters of FIGS. 14 and 15 correspond to the reference characters used in FIGS. 1–10 and thus need not be described in regard to FIGS. 14 and 15. As previously noted, the shear blade assembly operates through a series of inclined cams, as indicated at 201 in FIGS. 14 and 15, and corresponding cam followers 203. Book clamp 18 also operates through cams 203 and corresponding cam followers 205.

Figure 5:
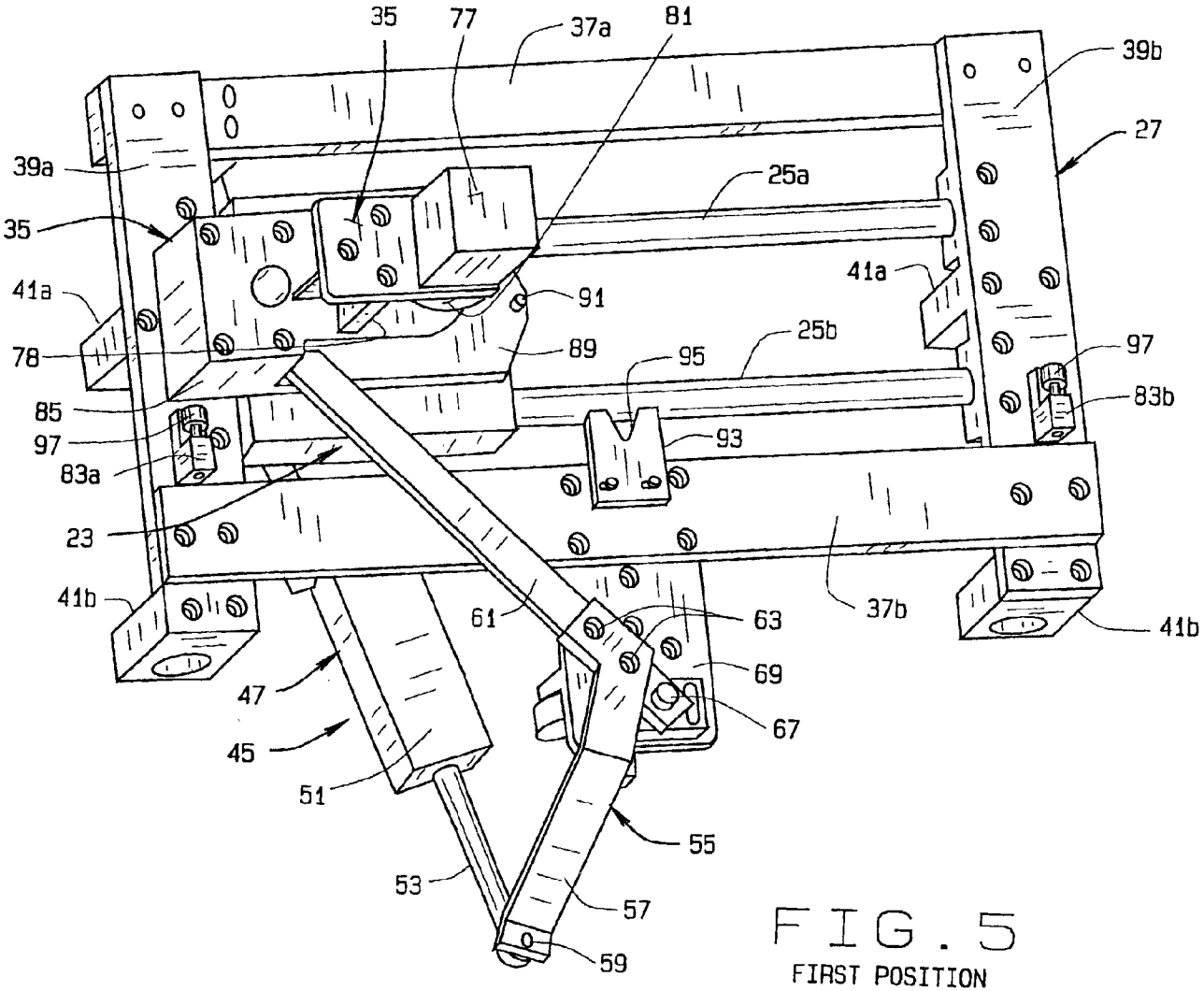
FIG. 5 is a perspective view of a sub-frame of the trimmer shown in FIGS. 3 and 4 having a pair of spaced horizontal slide rods on which a carriage is slidably mounted with the carriage having a book holder pivotally mounted thereon and with the indexing mechanism actuated so as to position the carriage in its first position so that a first of the minor edges of the book held by the book holder is generally parallel to the shearing plane of the shear plane, where the indexing mechanism is actuated by a double rod hydraulic actuator.
Figure 6:
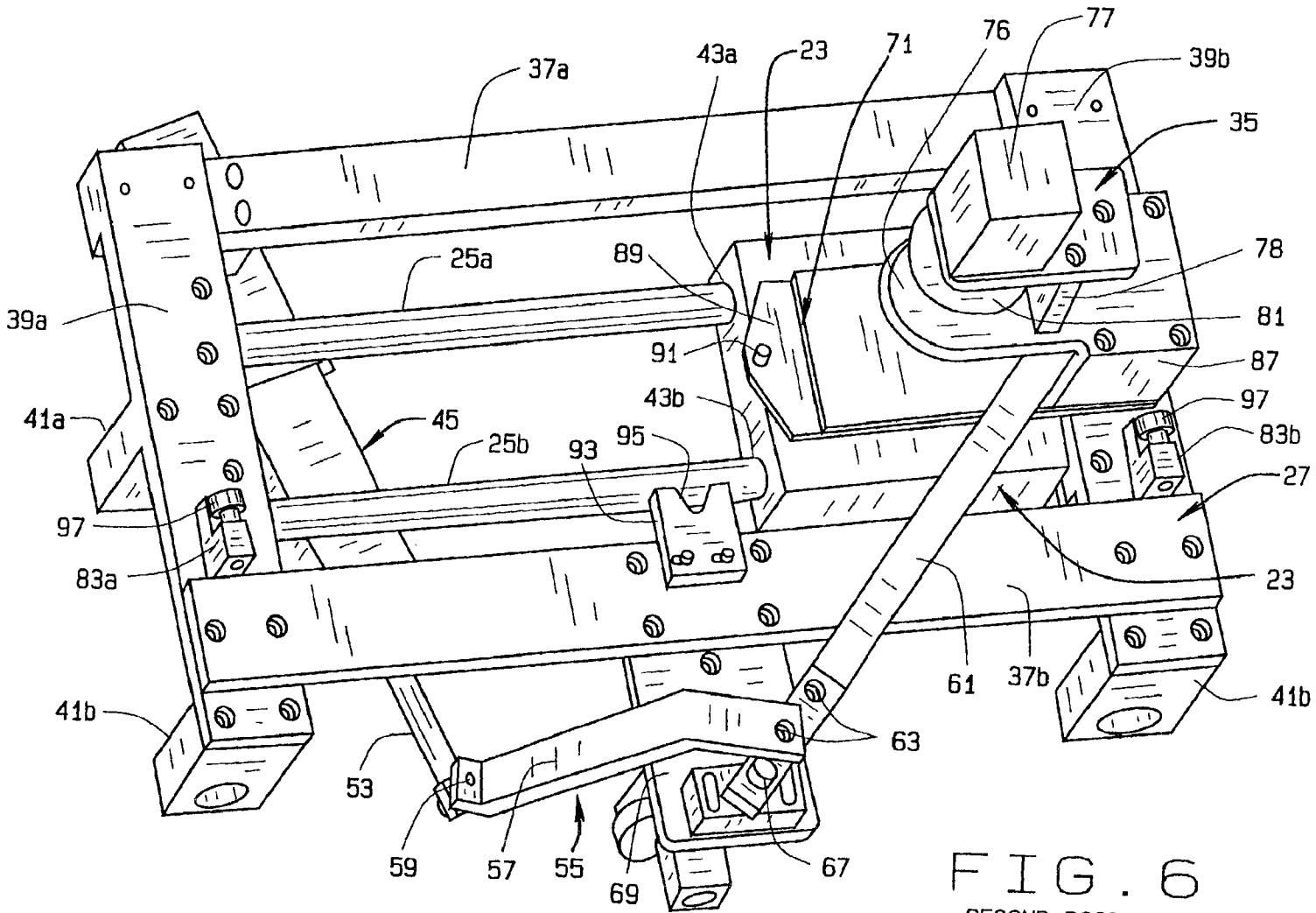
FIG. 6 is a view similar to FIG. 5 with the indexing mechanism actuated so as to move the carriage to its second position with the book holder and book gripped thereby rotated approximately 180° in clockwise direction from its position as shown in FIG. 5 so as to accurately position a second minor edge of the book parallel to the shear plane of the shear assembly.
Figure 7:
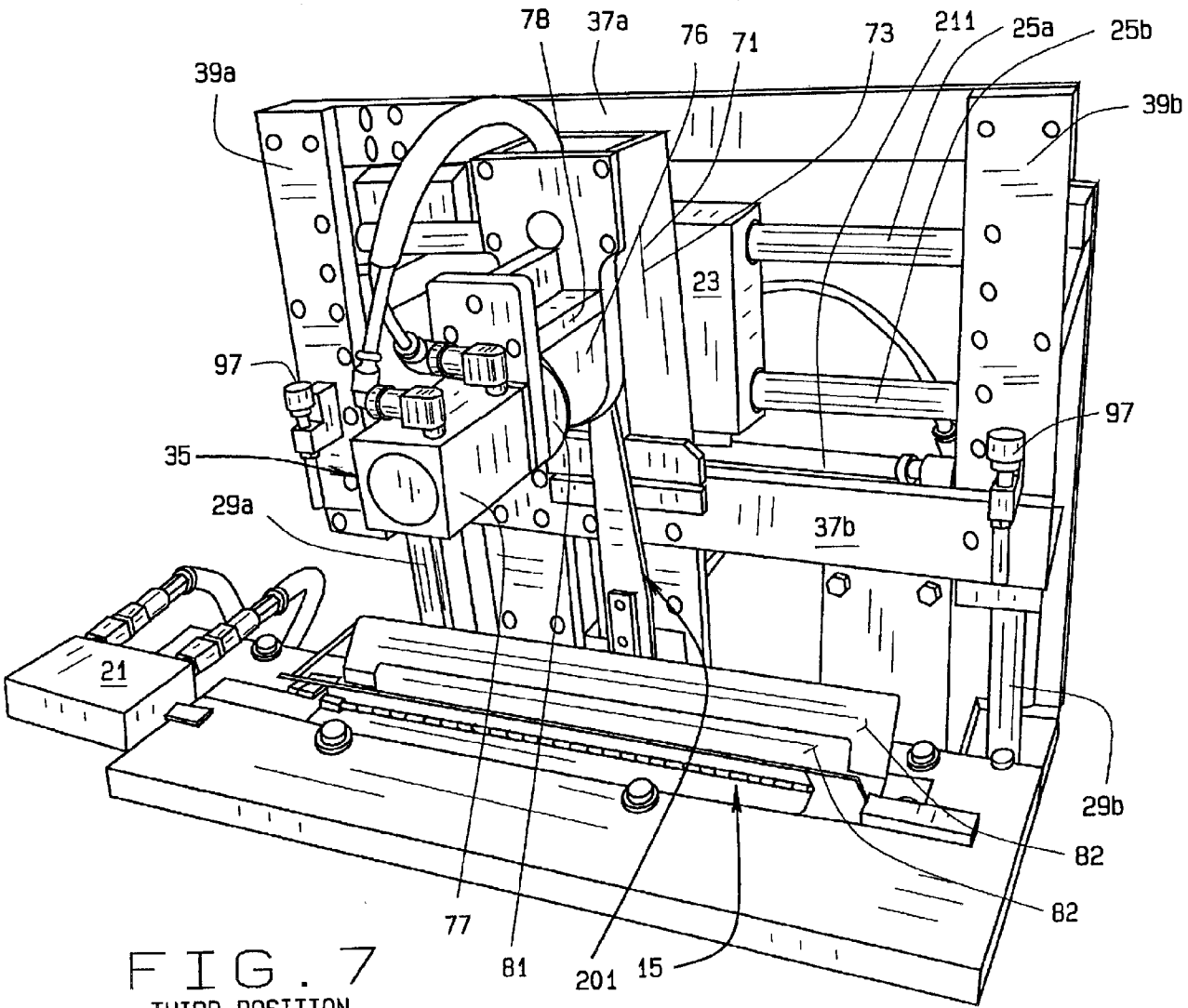
FIG. 7 is a view similar to FIGS. 5 and 6 with another embodiment of the indexing mechanism actuated so as to move the carriage to its third position with the book holder and book gripped thereby rotated approximately 90° in counterclockwise direction from its second position so as to accurately position a major edge of the book (i.e., the edge opposite the edge gripped by the holder) so as to be parallel to the shearing plane of the shearing assembly, where the indexing mechanism is actuated by a rodless hydraulic cylinder rather than the double rod hydraulic actuator, as shown in FIG. 5.

In accordance with this invention, trimmer 1 further has a carriage 23 supported on a pair of horizontal slide rods 25*a*, 25*b*. The carriage 23 is movable in horizontal direction relative to the shear blade 15 on these slide rods between a first position (as shown in FIGS. 3 and 5) in which a first edge or margin (e.g., minor edge M1) of the book may be trimmed, to a second position (as shown in FIG. 6) in which a second edge or margin (e.g., the other minor edge M2) of the book may be trimmed, to a third position (as shown in FIG. 7) in which a third edge or margin (e.g., major edge M3) of the book may be trimmed by shear blade 15.

Figure 8:
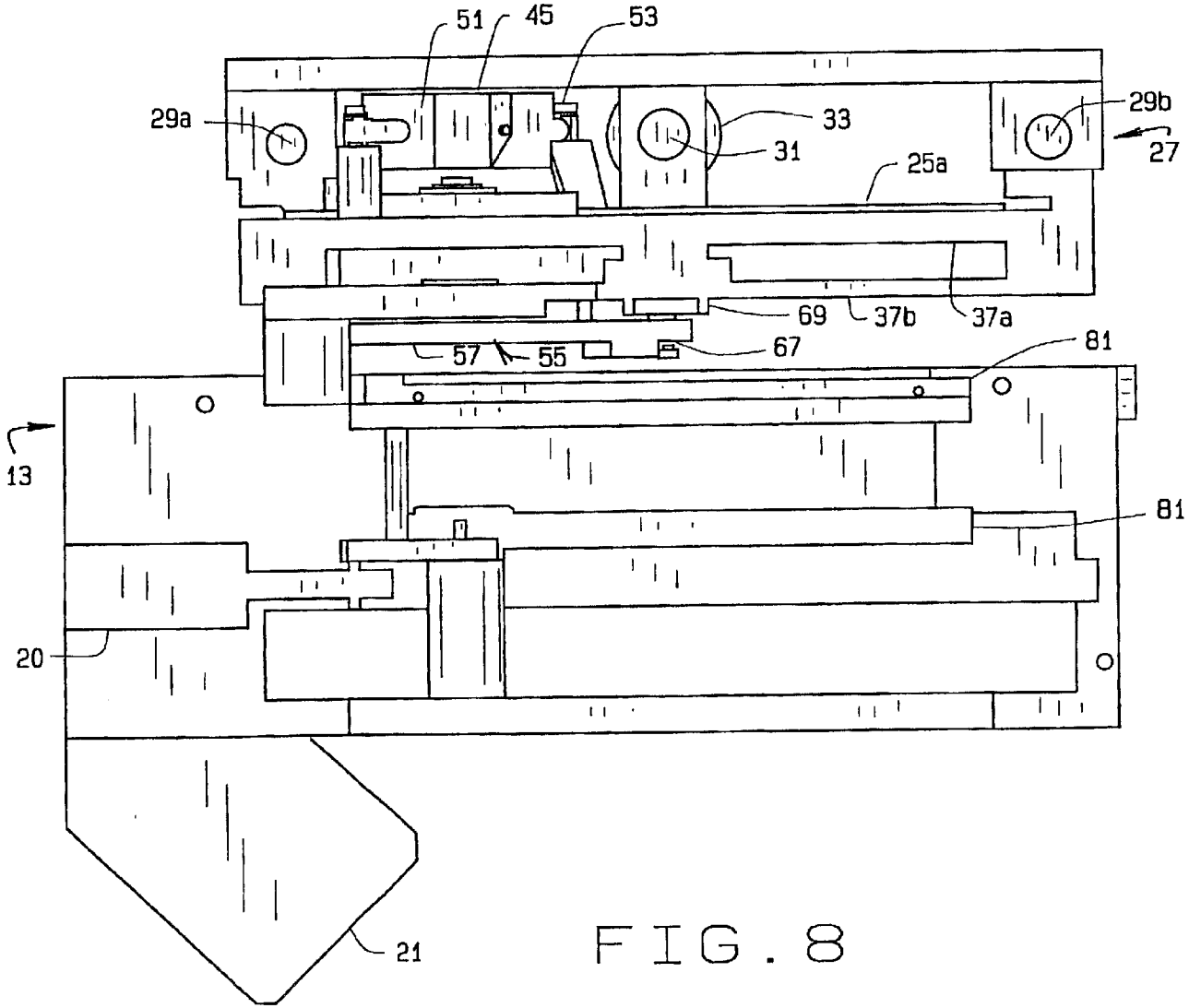
FIG. 8 is a top plan view of the trimmer, as shown in FIG. 3.

Slide rods 25*a*, 25*b* are part of a subframe 27 which in turn is mounted on a pair of vertically oriented slide rods 29*a*, 29*b* so that subframe 27 along with carriage 23 are movable in vertical direction with respect to the shearing plane SP of shear blade 15. Sub-frame 27 mounted on vertical slide rods 29*a*, 29*b* is selectively movable in vertical direction by means of a suitable power drive, such as a screw jack assembly 31 incrementally driven by a stepper motor 33 (or by other suitable drive), as shown in FIG. 8, such that the subframe and the carriage may be selectively moved a desired vertical distance with respect to the shear plane SP of shear blade 15 thereby to accurately move a book held by a book holder 35 carried on carriage 23 toward and away from the shear plane. In this manner, position the edges of the book to be trimmed may be accurately positioned with respect to the shear blade 15 such that upon actuation of the shear assembly 13 to close the shear blade 15, predetermined amounts of the margins M1–M3 of the book along the desired edges of the book may be sheared (cut or trimmed) thereby to produce a trimmed book having predetermined finished dimensions and where the trimmed edges are substantially perpendicular to one another. While the vertical drive for the subframe 27 is described as a screw jack driven by stepper motor 33, it will be understood that other types of well know linear actuators may be used. Further, as will be understood, the stepper motor 33 is under the control of the computer control system CS so as to accurately position each edge or margin M1–M3 of book B relative to the shear plane SP such that the desired margins M are trimmed from the book thereby to result in a trimmed book of the proper size and having the excess margins trimmed from the book. Computer control system CS may be of a wide variety of forms from a dedicated programmable controller to a conventional PC. The present invention utilizes a RPC 52 programmable controller commercially available from Remote Processing Corporation of Denver, Colo.

Sub-frame 27 is generally rectangular having upper and lower sills 37*a*, 37*b* and left and right stiles 39*a*, 39*b* with slide rails 25*a*, 25*b* rigidly secured to stiles 39*a*, 39*b*. Each of the vertical stiles 39*a*, 39*b* has a pair of slide bearings 41*a*, 41*b* mounted thereon with each pair of slide bearings slidingly receiving a respective vertical slide rail 29*a*, 29*b*. Carriage 23 is similarly provided with a pair of slide bearings 43*a*, 43*b* for slidingly receiving a respective slide rail 25*a*, 25*b*. It will be understood that the above noted slide bearings 41*a*, 41*b* and 43*a*, 43*b* have a close tolerance sliding fit with their corresponding slide rails 29*a*, 29*b* and 25*a*, 25*b* such that the carriage and the sub-frame are substantially constrained to only move in the axial direction of their respective slide rails.

An indexing mechanism, as generally indicated at 45, is carried by sub-frame 27 for accurately moving carriage 23 between its first, second and third positions (as heretofore described) and for rotating holder 35 such that first, second and third edges or margins M1–M3 of the book are presented to shear blade 15 for trimming predetermined amounts from the edges of the book B so as to result in a finished or trimmed book of predetermined finished dimensions. As best shown in FIG. 5, indexing mechanism 45 is shown to comprise an actuator 47, preferably a two cylinder hydraulic actuator. Specifically, actuator 47 has a first rod end 49 pinned to with respect to sub-frame 27, as indicated at 50 (see FIG. 4), a cylinder body 51, and a second rod 53 pivotally coupled to a bell crank 55. Bell crank 55 has a first arm 57 having its free end pivotally connected to rod 53, as indicated at 59. The bell crank further has a second arm 61 rigidly connected to arm 57, as indicated at 63, such that arms 57 and 61 are rigidly fixed relative to one another such that the arms are roughly at an angle of about 120° relative to one another. The free end of arm 61 is pivotally connected to book holder 35, as indicated at 65 (see FIG. 4), in a manner as will be further described hereinafter. As indicated at 67, the center portion of bell crank 55 is pivotally secured to a stationary member 69 fixedly secured to lower sub-frame rail 37*b*.

More specifically, book holder 35 includes a plate 71 pivotally mounted on carriage 23 to pivot about a pivot point 73, as shown in FIG. 4. A pair of spacers 74 extend outwardly from plate 71 and an anvil 76 is carried thereby so as to be spaced from plate 71 such that the outer surface of the anvil is generally in the same vertical plane of the vertical face of shear platen 19 (see FIG. 4). A gripping actuator 77 (e.g., a selectively operable hydraulic or air cylinder) is supported by a rigid block 78 so as to be spaced outwardly from anvil 76. The actuator 77 preferably (but not necessarily) is a piston and cylinder fluid actuator having an actuator rod 80 (see FIG. 9) carrying a gripping plate 81. Upon actuation of actuator 77 (i.e., upon admitting a suitable fluid, such as air or hydraulic fluid, into the cylinder so as to effect movement of the piston in the cylinder), rod 80 (which is operatively connected to the piston) and gripping plate 81 carried by the rod are movable between a retracted position (as shown in FIGS. 4 and 7) in which a book B to be trimmed may be placed within holder 35 and positioned between anvil 76 and gripping plate 81 and a closed or gripping position in which the gripping plate 81 forcefully presses the book B between the gripping plate and anvil 76 thereby to securely grip book B. It will be understood that with carriage 23 in its first position (see FIG. 5) and with the actuator 77 in its gripping position and with the book B gripped tightly between gripping plate 81 and anvil 76, one edge of book B is disposed substantially in the same plane as the shearing plane SP between the edge of blade 15 and platen 19.

It will be further noted that shear 13 is provided with book guides 82 which aid an operator in inserting a book in holder 35 and guiding the cover and the pages of the book as it is inserting into the opening between blade 15 and shear platen 19. It will be understood that with the book B in position to be trimmed and with the carriage in its first position, as the carriage is moved to its second and third positions and as the book B is rotated so as to trim the second and third edges or margins of the book, at least a portion of the book remains within the opening between shear blade 15 and shear platen 19 and between guides 82 so that the pages and the covers of the book are maintained in a desired position to be sheared and so that the pages and the cover are not damaged as the carriage moves and as the book is rotated. As shown in FIG. 7, guides 82 are hingedly mounted with respect to the trimmer frame so that they are free to move in a vertical plane with the book as the shear blade 15 closes. This allows somewhat thinner books to be trimmed. After the edges of book B have been trimmed, actuator 77 may be operated to move the gripping plate 81 toward its retracted position thereby to release the trimmed book.

As shown in FIGS. 5 and 7, sub-frame 27 has a pair of stops 83*a*, 83*b* for engagement by a respective lower horizontal surface of holder 35. That is, with carriage in its first position, as shown in FIG. 5, the lower horizontal surface 85 of holder 35 will be in engagement with its corresponding stop 83*a* thereby to insure that the carriage is substantially horizontal and to insure that the spine S of book B gripped by holder 35 is substantially vertical. This in turn will insure that the first minor edge M1 of the book to be trimmed in the manner described above is substantially parallel to shear plane SP. Likewise, with carriage 23 in its second position, as shown in FIG. 6, another horizontal surface 87 on holder 35 will be in engagement with its respective stop 83*b* so as to insure that the holder is substantially horizontal and so that the other minor edge M2 of book B is parallel to the shear plane SP.

Referring to FIGS. 5–7, book holder 35 has a plate 71 which has a pin 91 extending therefrom toward shear 15. Member 37*b* of sub-frame 27 has a stationary center stop plate 93 rigidly affixed thereto and this stop plate has a V-shaped notch 95 in its upper edge, with this V notch being substantially centered relative to the movement of carriage 23 along slide rods 25*a*, 25*b*. As carriage 23 is moved from its second to its third position (as heretofore described) and as the holder 35 is rotated in counterclockwise direction approximately 90°, pin 91 is received in V notch 95 thereby to centrally locate the carriage along slide rods 25*a*, 25*b*. Also, with pin 91 received in V notch 95, bell crank 55 under the force of indexing actuator 45 exerts a downwardly acting force on carriage which tends to orient holder 35 such that the major edge M3 to be trimmed of book B gripped by the holder is substantially parallel to the shear plane SP. It will be understood that preferably, stops 83*a*, 83*b* may be provided with screw adjustments and elastomeric pads 97 to serve as the active elements of the stops engageable by horizontal surfaces 85, 87 thereby accurately position the minor edges M1 and M2 of book B so as to be parallel to the shear plane SP so as to insure that upon actuation of shear assembly 13 that the trimmed minor edges of the book will be substantially parallel to one another.

Figure 9:
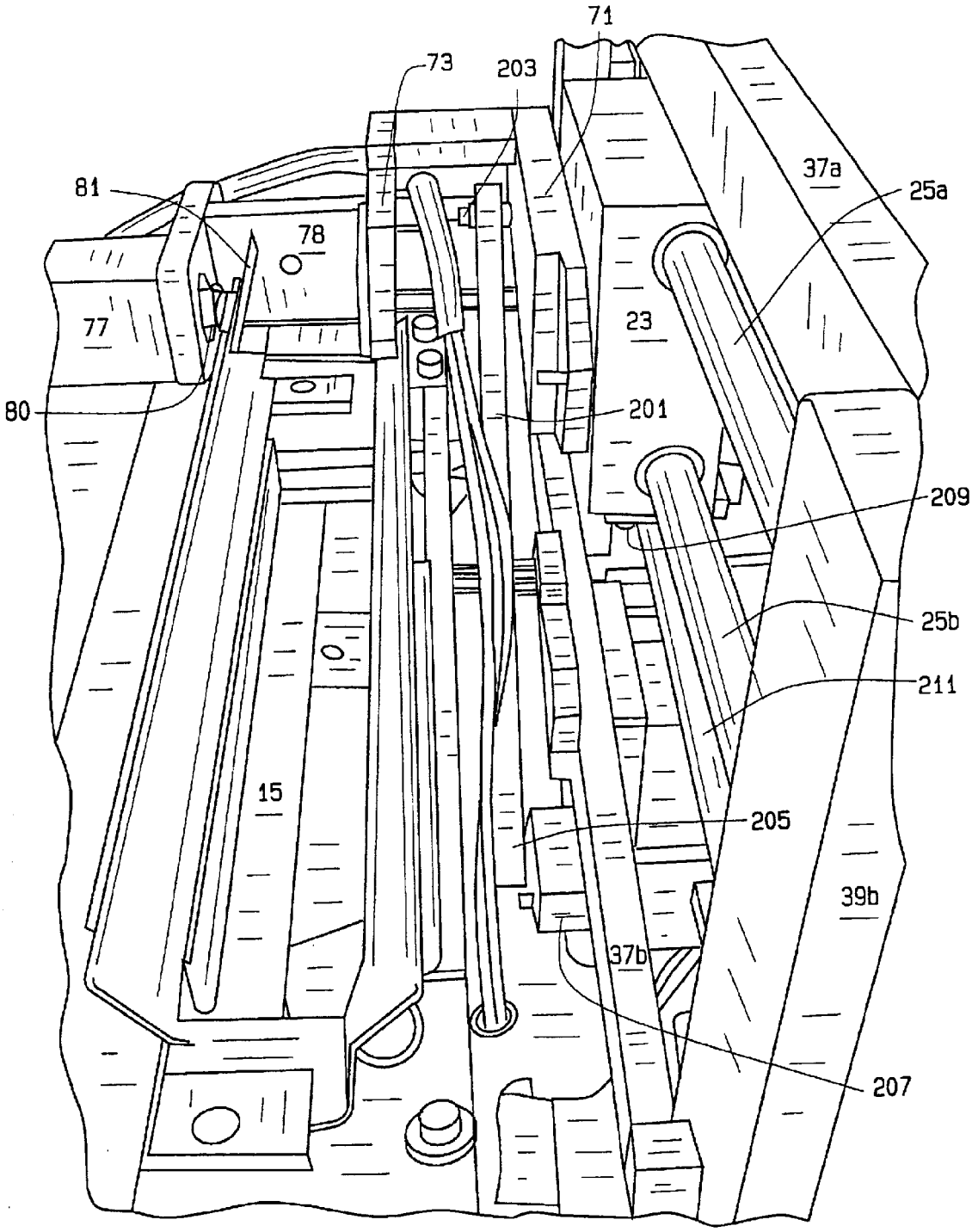
FIG. 9 is a side perspective view of the trimmer from the right side as it is shown in FIG. 7 illustrating the second embodiment of the indexing mechanism.
Figure 10:
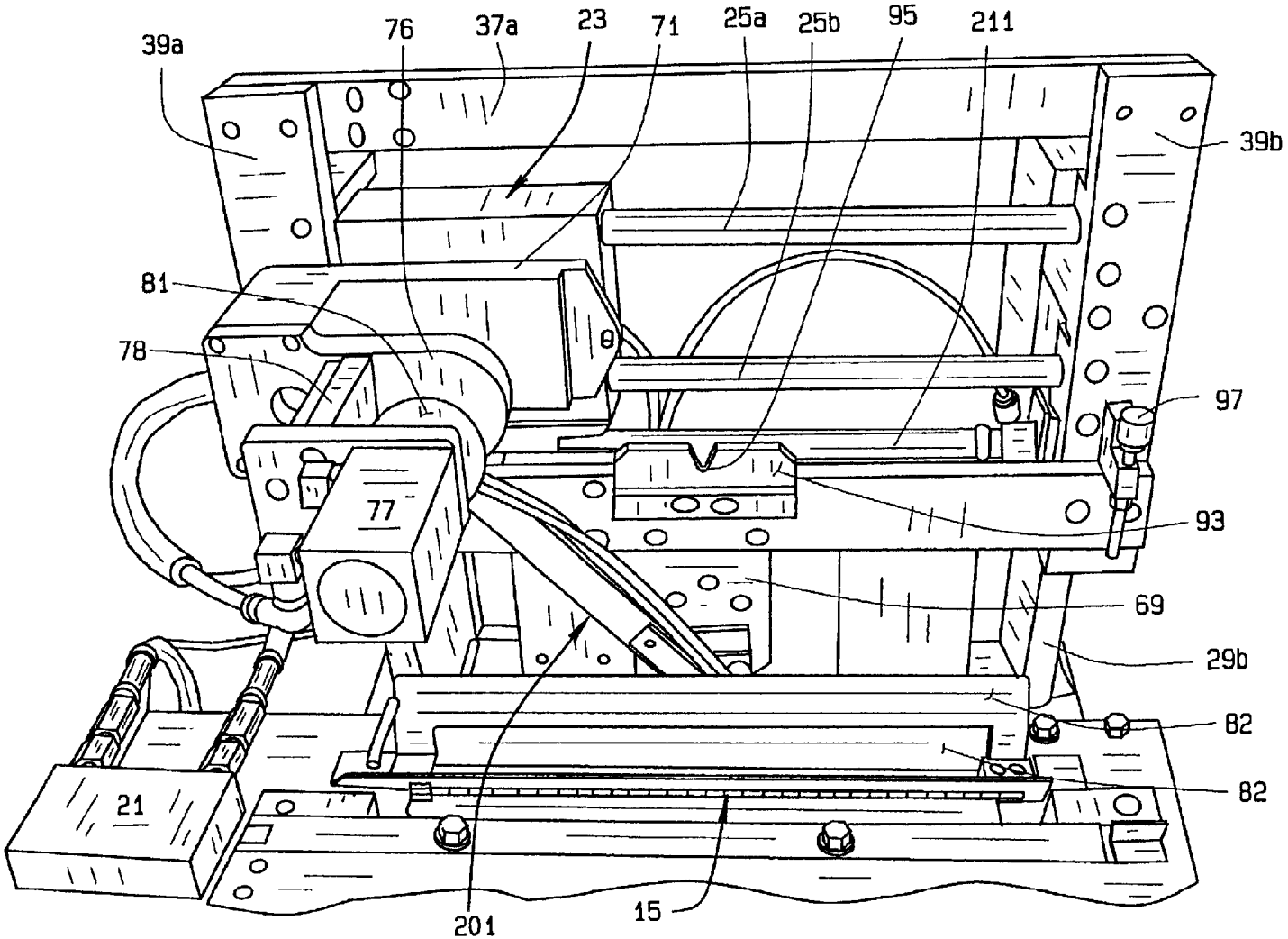
FIG. 10 is a front perspective view of the trimming mechanism shown in FIGS. 7–9 with the carriage and holder in its first position.
Figure 11:
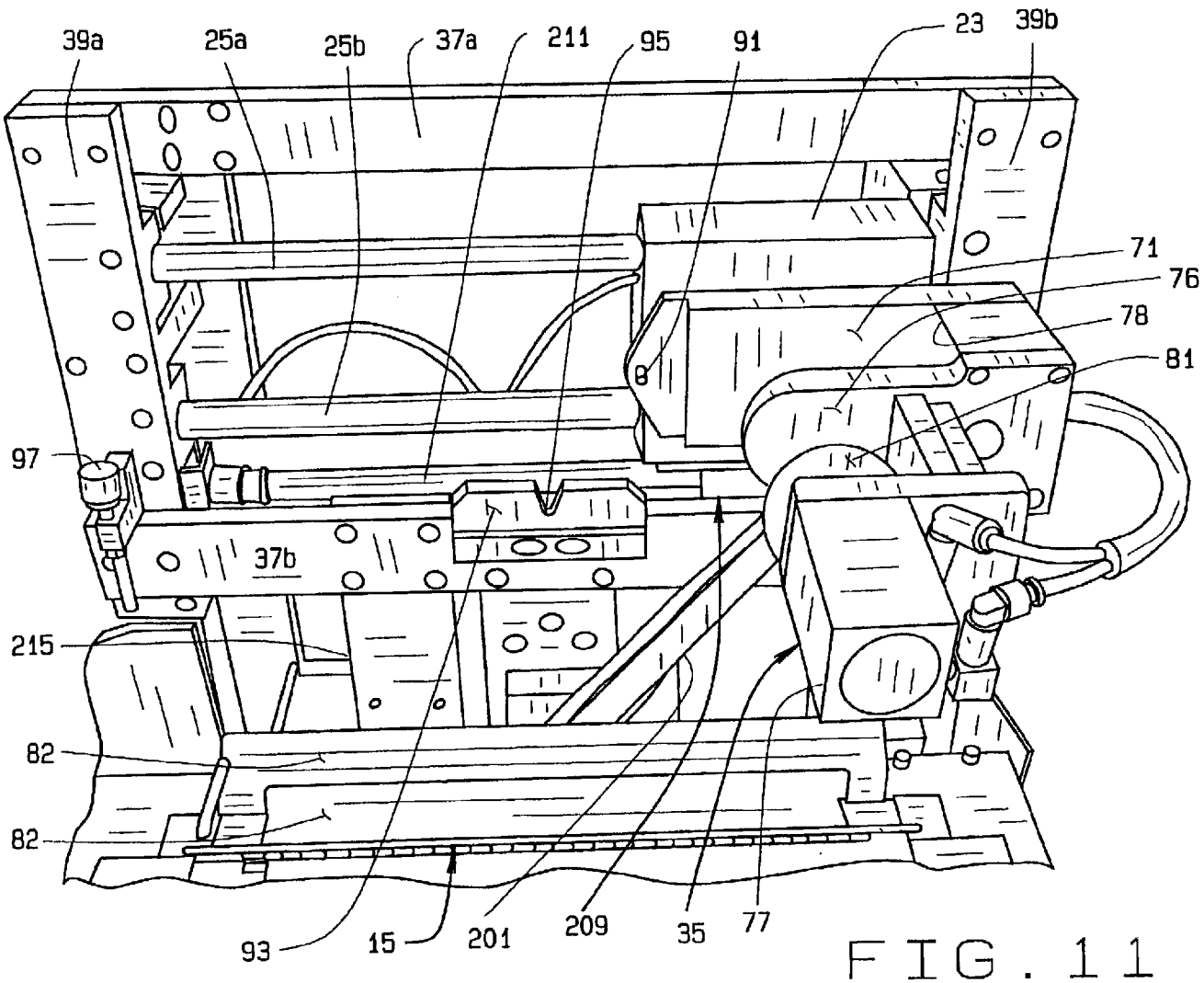
FIG. 11 is a view similar to FIG. 10 with the carriage and the holder in its above said second position.

As shown in FIG. 4, pivot 59 is offset from pivot 67. In accordance with this invention, it is preferred (but not required) that the pivots for the indexing mechanism or linkage be substantially co-planar, as shown in FIGS. 7–11. In these last mentioned drawing figures, offset bell crank 55 of FIGS. 3–6 has been replaced with a straight link 201 which, as indicated at 203 in FIG. 9, is pinned at one end to plate 71 which in turn is connected to carriage 23. The other end of link 201 is pinned, as indicated at 205, to a stationary block 207 mounted substantially mid-way between the ends of slide rods 25*a*, 25*b*. This link 201 causes the book holder 35 to rotate with respect to carriage 23 as the latter moves between its first, second and third positions, as heretofore described. In place of actuator 47, the carriage 23 is forcefully driven by a rodless hydraulic cylinder 209, such as is commercially available from the Bimba Manufacturing Company of Monee, Ill., under the trade designation as an Ultratran rodless cylinder (magnetically coupled). The rodless cylinder 209 is mounted on a slide rod 211 parallel and positioned below slide rod 25. The rodless cylinder 209 serves as a linear actuator for moving carriage 23 along slide rods 25*a*, 25*b* between its first, second and third positions. It will be understood that with the carriage 23 in its first position, as shown in FIG. 10, the rod holder 35 will be rotated in a first position in which it is in engagement with the left-hand stop 97 thereby to accurately orient a first edge M1 of the book B held by the book holder to be parallel to the shearing plane SP. Upon actuation of the rodless cylinder 209 to effect movement of carriage 23 from its first to its second position (as shown in FIG. 11), the rodless cylinder will effect sliding movement of carriage 23 along the full length of slide rods 23*a*, 23*b*, and the body of the book holder 35 will be in engagement with right-hand stop 97. Of course, as the carriage travels along the slide rods 25*a*, 25*b* for its first position to its second position, the link 201 will cause the book holder 35 to rotate relative to carrier through an angle of about 180° and the book holder 35 will come into engagement with a respective stop 97 so as to position the second edge M2 of the book so as to be parallel to the shearing plane SP. Then, after the second edge has been trimmed, as the carriage moves from its second to its third position, the link 201 will cause the book holder to rotate in reverse direction 90°. As the carriage and book holder move to their third position, a fluid cylinder 215 mounted on the back side of frame member 37*b* (see FIG. 11) may be actuated so as to extend its rod (not shown) with the later serving as a movable stop pin engageable by the carriage thereby to accurately locate the carriage in its third position with pin 91 received in V notch 95 of plate 93. In this manner the third edge M3 of the book positioned parallel to the shearing plane SP. Of course, it will be understood that with the book in the above-said first, second or third position, the carriage may be moved vertically on vertical slide rods 29*a*, 29*b* so as to vertically position the book relative to the shearing plane such that upon actuation of the blade 15, a predetermined amount of the book B along a respective edge will be trimmed.

As can best be seen in FIGS. 3 and 4, the trash trimmed from the margins M1–M3 or edges of book B by blade 15 is below the level of the blade such that as the trash (i.e., the excess margins along the edges of the book B, as shown by the dotted lines in FIG. 2), such that as the shear blade 15 cuts these excess margins from book B, the trash will fall by gravity downward. A suitable trash chutes or guides TG is provided below the level of shear blade 15 so as to direct the trash downwardly to a suitable trash container TC, as illustrated in FIG. 1.

As shown in FIG. 3, a diverter tray DT is provided below shear blade 15 so as to receive the excess margins trimmed from the book (such excess margins being referred to as trash) or to receive the trimmed book. The diverter tray DT is movable by means of a selectively actuable fluid cylinder 301 (see FIG. 12D) between a trash receiving position in which the trash is directed so as to fall by gravity onto a trash tray TT which in turn directs the trash by gravity into trash container TC. Upon completing trimming of book B, diverter tray DT is shifted from its trash receiving position to a book delivery position in which a completed book released from book holder 35 will fall downwardly onto the diverter tray and be directed onto a horizontal surface which serves as a book delivery tray BT (see FIG. 1).

Preferably, trash container TC is a waste can supported on a slide out support such that the operator may readily remove the trash container so as to empty it and to place an empty trash container within the trimming apparatus 1 of this invention. In accordance with this invention, trash guide TG is selectively movable between a first position for directing the trash downwardly toward trash container TC, as described above, and a second position such that as a trimmed (finished) book B is released by book gripper 35 is released, the book will fall downwardly through shear assembly 13 onto the upper surface of the trash guide TG so that he book is directed onto a horizontal book table BT below the level of the shear assembly As seen in FIG. 1, a book removal opening 10 is provided in the front of cabinet 7 below work opening 9 thereby to permit the operator to readily remove the finished book from the trimmer.

The kinematics of indexing mechanism 45 or the modified mechanism using rodless cylinder 209 may be more clearly understood from a description of its operation. With carriage 23 in its first position, as shown in FIG. 5, the carriage is disposed toward one end (the left end, as shown in FIG. 5) of slide rods 25*a*, 25*b*, and actuator 45 is in a condition where both rods 49 and 53 are extended such that bell crank 55 is positioned such that arm 61 is in its leftmost position. With rodless cylinder 209, it is actuated such that the carriage 23 is at the left-hand ends of the slide rods 25*a*, 25*b*, as shown in FIG. 7. This in turn positions holder 35 such that a book B may be inserted therein for being gripped by gripping actuator 77 along the spine of the book substantially midway between the minor edges M1 and M2 of the book with one of the minor edges of the book (e.g., edge or margin M1) facing downwardly and being disposed substantially parallel to the horizontal shear plane SP of shear 13. With this first minor edge being so disposed such that it is parallel to shear plane SP, stepper motor 33 under the control of a control system CS is energized so as to rotate screw jack 31 a predetermined amount to raise or lower sub-frame 27 on vertical slide rods 29*a*, 29*b* so as to position this first minor edge of book B is a predetermined location with respect to the shear plane so that upon actuation of shear assembly 13, a predetermined amount of the margin M of the book B along this first minor edge is trimmed from the book. After this first minor edge or margin of book B gripped by gripping actuator 77 has been trimmed to a predetermined dimension, actuator 45 is actuated such that rod 49 is retracted into the actuator body 47 thus causing arm 57 of bell crank 55 to rotate clockwise (as shown in FIG. 6) about pivot point 67 such that the carriage 23 is slid along slide rods 25*a*, 25*b* from the left side of sub-frame 27 to the right side. In the case of rodless cylinder 209, it is actuated to effect movement of the carriage from its first position to its second position (as shown in FIG. 11). When moved from its first to its second position either by actuator 45 or by rodless cylinder 209, holder 35 is rotated through an angle of about 180° such that the other minor edge M2 of book B is disposed downwardly toward shear blade 15 such that this other minor edge is substantially parallel to shear plane SP. Again, stepper motor 33 is actuated under the control of control system CS so as effect rotation of screw jack 31 so as to accurately vertically position book B with respect to the shear plane SP such that a predetermined amount of the book along this second minor edge will be trimmed upon actuation of the shear assembly 13 by control system CS. After the second minor edge has been trimmed to its predetermined dimension, control system CS effects actuation of indexing actuator 45 such that both rods 49 and 53 are retracted into actuator body 51 thereby to effect rotation of bell crank 55 about pivot point 67 thereby to move carriage 23 to its third position in which the carriage is located substantially centered between the ends of slide rods 25*a*, 25*b*. Of course, the control system CS may also actuate rodless cylinder 209 to move the carriage to its third position (see FIG. 10). As the carriage is moved to its third position by either actuator 45 or by rodless cylinder 209, holder 35 along with book B held thereby is rotated approximately 90° in counterclockwise direction (as viewed in FIG. 6) such that the major edge M3 of the book B opposite the spine S (which is gripped by gripping actuator 79) is disposed parallel to shear plane SP. Again, under the control of control system CS, stepper motor 33 is energized so to effect rotation of screw jack 31 to in turn raise or lower sub-frame 27 on vertical slide rods 29*a*, 29*b* so that a predetermined amount of the excess margin of the book along this major edge M3 is positioned below the level of shear plane SP such that upon actuation of shear assembly 13, shear blade 15 will trim this margin M3 from the book. Upon completion of this trimming operation, shear blade 15 will be retracted (opened) and the trimmed book will be released by gripping actuator 77 so as to fall downward though shear assembly 13 for discharge from the trimming apparatus. It will be understood that stepper motor 33 and screw drive 31 cooperate to result in relatively small increments of vertical movement of carriage 23 along with book B held in holder 35 toward and away from the shear plane SP of shear blade 15. For example, the book may be moved in increments as small as $1/1000^{th}$ (0.001) inches.

Figure 12:
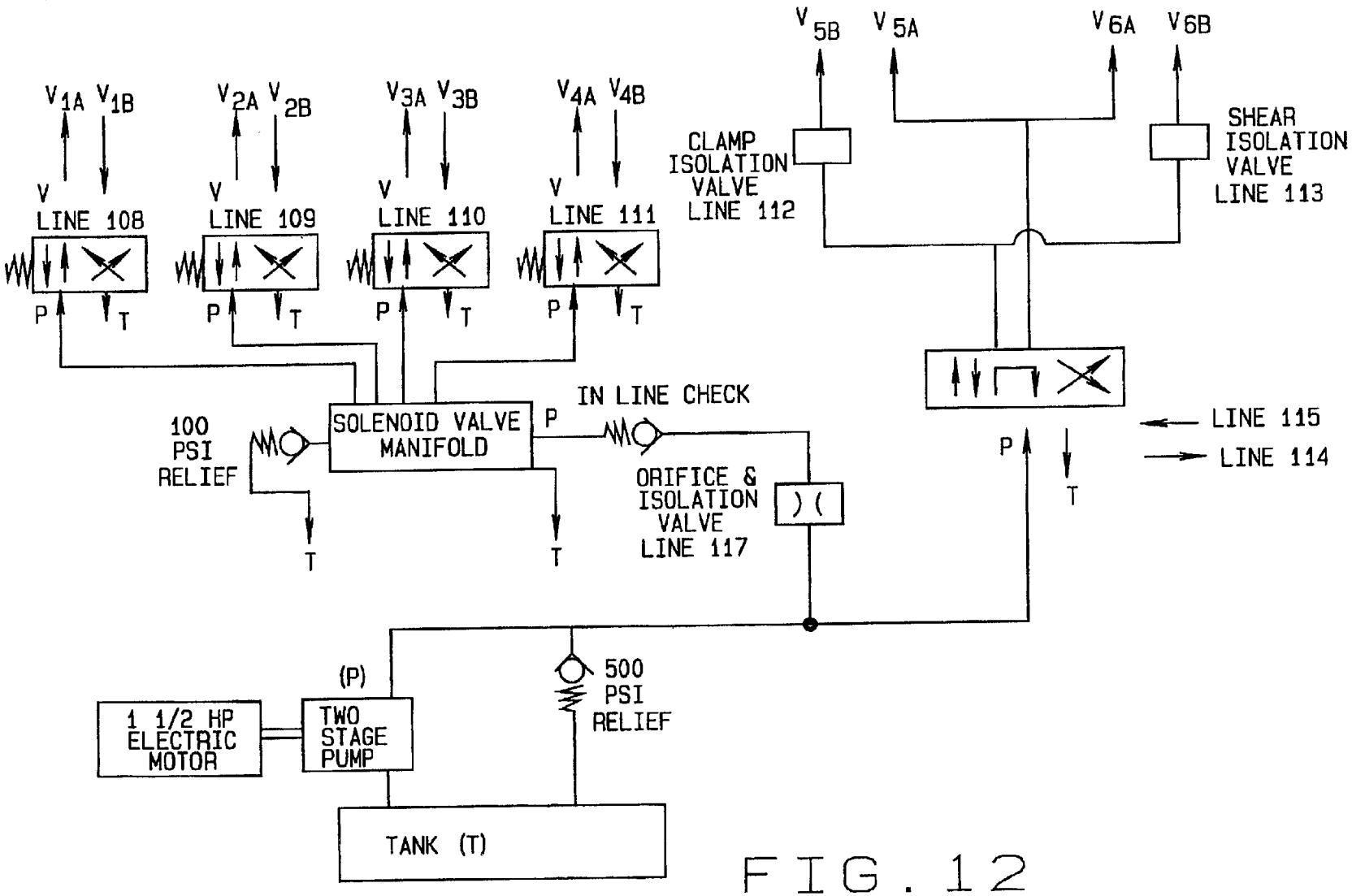
FIG. 12 is a schematic of the hydraulic system for the trimmer of the present invention.

Referring now to FIG. 12, a hydraulic schematic diagram is shown for operating the various hydraulic cylinders heretofore described in a manner well known to those skilled in the art.

Figure 12B:
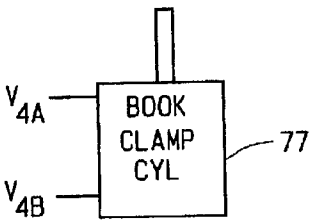
FIG. 12B is a hydraulic schematic for the book clamp.
Figure 12D:
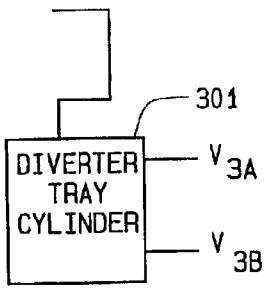
FIG. 12D is a hydraulic schematic for the book and trash chute.
Figure 12A:
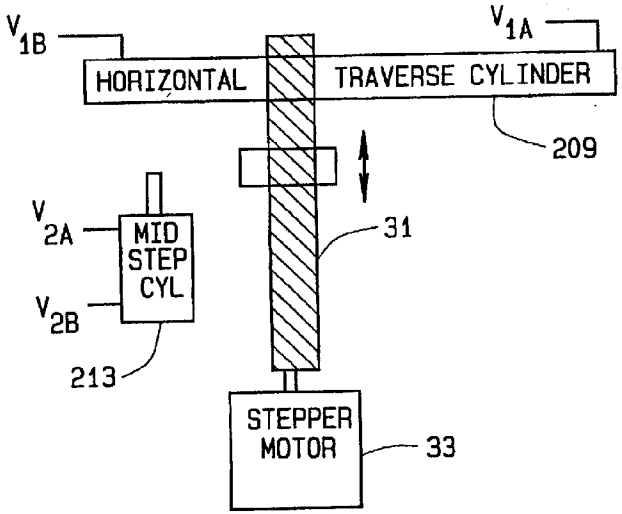
FIG. 12A is a schematic for the stepper motor and screw jack that raises and lowers the carriage with respect to the shear plane.

FIG. 12A is a diagrammatic view illustrating the stepper motor 33 operating through screw jack 33 to raise and lower carriage 23 on vertical slide rods 29*a*, 29*b* for vertically moving an edge of the book B toward and away from the shear plane SP. Also shown is the rodless cylinder 209 which effects horizontal movement of carriage 23 along slide rods 25*a*, 25*b*.

FIG. 12B illustrates book clamp cylinder 77.

Figure 12C:
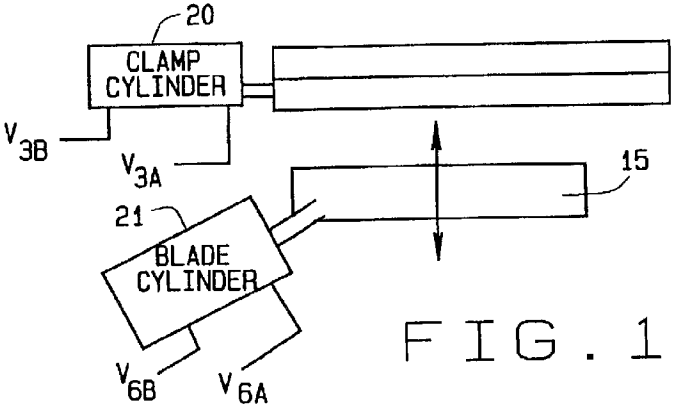
FIG. 12C is a hydraulic schematic for the shear mechanism.

FIG. 12C illustrates clamp cylinder 20 and shear cylinder 21.

FIG. 12D illustrates diverter tray fluid cylinder 301 which is operatively connected to diverter tray DT for hingedly moving the diverter tray between its trash receiving and book discharge positions.

Figure 13:
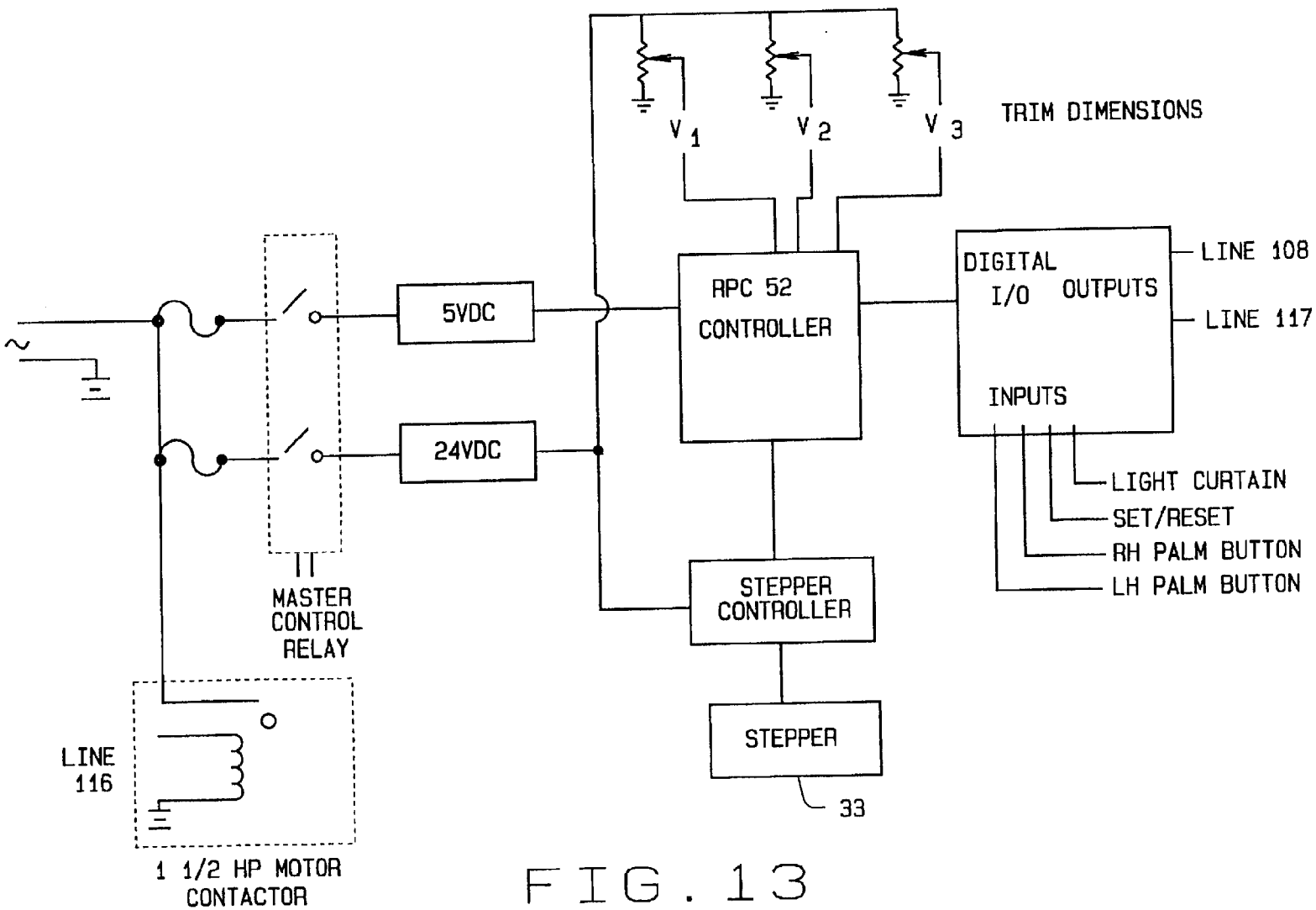
FIG. 13 is an electrical schematic for the trimmer.

FIG. 13 is an electrical schematic of the trimmer of the present invention. The trimmer is controlled by a suitable programmable process controller, such as the heretofore described RPC 52 process controller. The program for controlling operation of the trimmer is set out below. From this disclosure, one skilled in the art could readily make and use the trimmer herein disclosed.

It will be noted that the adjustable voltage elements V1–V3 are used to set the dimensions of the book to be trimmed. For example, these could be rotary potentiometers. However, in a more preferred from, these adjustable voltage elements are better converted to a digital keypad which an operator may use to enter the dimensions of the book. The code, as set forth below, does in fact employ such a digital keypad to enter the dimensions of the book.

It will be appreciated by those skilled in the art that while the apparatus of the present invention has been described to trim two minor edges and one major edge of book B, the apparatus of the present invention could readily be used to trim two major edges and one minor edge.

Control Program

```
001 REM NOTES TRIM9.TXT 10/19/00 Uses Keypad &
    Display
002 REM CONFIGURE DIG I/O BOARD
003 REM CONFIG LINE 100,5,255,255,0
010 REM INPUTS AND OUTPUTS
011 REM LINE EVENT
012 REM INPUTS
013 REM LEFT HAND TRIP(16) 100
014 REM RIGHT HAND TRIP(17) 101
015 REM RESET PUSH BUTTON(18) 102
016 REM MCR STATUS(19) 103
017 REM PRESSURE SWITCH(20) 104
030 REM OUTPUTS
031 REM HORIZONTAL MOVE 108
032 REM CENTER STOP PIN 109
033 REM EXTEND DROP CHUTE 110
034 REM BOOK CLAMP VALVE 111
035 REM SHEAR CLAMP VALVE 112
036 REM SHEAR VALVE 113
037 REM
038 REM
039 REM SHEAR PUMP POWER 116
040 REM LOW PRESSURE PUMP 117
118 REM *****SUBROUTINES*****
119 REM
120 REM 5200 ALL I/O OFF
121 REM 5300 MANUAL SET UP
122 REM 5400 OFF, OPEN BLADE, HOME, CLOSE
    BLADE
123 REM 5500 VERTICAL SET USING V3
124 REM 6000 MAIN ROUTINE
125 REM 7000 DELAY USES D1
126 REM 7500 INTEGER TO STRING V0 IS SOURCE
    $(1) IS OUTPUT WITH "M"
127 REM 8500 INITIALIZES STEPPER
128 REM 9200 STEPPER MOVE $(2) VELOCITY $(1)
    DISTANCE ABSOLUTE
129 REM 9500 SEND STEPPER A COMMAND
130 REM 9600 KEYPAD ENTRY FOR V1, V2,& V3
1000 STRING 421,20
1001 DIM RETCMD(30)
1002 $(10)="123A456B789C.0#D"
1003 $(11)="C-CLEAR D-ENTER"
1004 ASC($(11),17)=13
1040 M1=86.081:REM COUNTS PER VOLT
1041 M2=11.6169:REM STEPS PER COUNT
1042 M3=3.17
1043 M4=M3+1.29
1050 D1=0.5
1060 X1=1
1065 DEVS=128+1
1066 GOSUB 5200:REM I/O OFF
1067 LINE116,ON:REM PULL THE BLADE BACK
1068 D1=3:GOSUB 7000
1069 LINE116,OFF
1070 $(1)="M10000"
1075 V4=0
1080 $(2)="V1000"
1081 CLEAR COM(1)
1082 $(0)="I1":GOSUB 9500
1083 $(0)="V1500":GOSUB 9500
1084 $(0)="F0":GOSUB 9500
1085 $(0)="M1000":GOSUB 9500
1094 GOSUB 9600
1100 GOSUB 5400:GOSUB 5500
1200 X=1
1205 CLEAR KEYPAD
2000 DO
2001 A=0
2005 A=KEYPAD(0)
2010 IF A=16 THEN GOSUB 9600
2015 IF A=12 THEN GOSUB 5300
2017 IF A=4 GOSUB 5400:GOSUB 5500
2050 IF LINE(100)=0 THEN X=0
3000 WHILE X=1
3004 LINE117,ON
3005 LINE111,ON :LINE110,ON
3010 DO
3015 IF LINE(101)=0 THEN GOSUB 6000
3020 WHILE LINE(100)=0
3025 X=1
3030 GOSUB 5200:REM I/O TO OFF
3050 D1=1:GOSUB 7000
3060 LINE117,OFF
4999 GOTO 1200
5200 REM SHUT ALL I/O OFF
5201 LINE108,OFF
5201 LINE109,OFF
5203 LINE110,OFF
5204 LINE111,OFF
5205 LINE112,OFF
5206 LINE113,OFF
5207 LINE114,OFF
5208 LINE115,OFF
5299 RETURN
5300 REM SETUP ROUTINE
5305 DISPLAY (3,0),"SETUP—LEFT PB"
5310 GOSUB 5200
5320 LINE117,ON
5330 DO:WHILE LINE(100)=1
5340 LINE108,ON
5341 D1=3:GOSUB 7000
5350 DO:WHILE LINE(100)=1
5360 LINE109,ON :LINE108,OFF
5361 D1=3:GOSUB 7000
5370 DO:WHILE LINE(100)=1
5380 LINE108,ON:LINE109,OFF
5381 D1=0.5:GOSUB 7000:LINE108,OFF
5385 D1=1.5:GOSUB 7000
5390 LINE117,OFF
5395 DISPLAY (3,0),"READY"
5399 RETURN
5400 REM THE FULL RESET ROUTINE
5401 ONTICK.25,5800
5402 DISPLAY (3,0),"FULL RESET"
5405 GOSUB 5200
5410 LINE117,ON
5415 LINE116,ON
5420 D1=2:GOSUB 7000
5445 LINE116,OFF, LINE117,OFF
5455 GOSUB 8500:REM "HOME" STEPPER
```

```
5470 LINE113,ON:REM CLOSE BLADE
5485 LINE116,ON
5490 D1=2:GOSUB 7000
5495 LINE116,OFF:GOSUB 5200
5497 ONTICK 0,5800
5498 DISPLAY (3,0),"READY"
5499 RETURN
5500 REM THE VERTICAL SET ROUTINE
5502 DISPLAY (3,0),"NEST SET"
5510 V0=V3:REM MOVE TO SET
5520 GOSUB 7500:GOSUB 9200
5530 D1=1*ABS((V4-V0)/1500):GOSUB 7000:V4=V0
5535 DISPLAY (3,0),"READY"
5599 RETURN
5800 IF LINE(105)=0 THEN RETI
5810 LINE116,OFF:LINE117,OFF
5805 DO:
5807 PRINT"!"
5808 WHILE LINE(105)=
5810 LINE116,ON
5899 RETI
6000 REM SUB THE MAIN CUT ROUTINE IT ASSUMES THE BLADE AND NEST IS IN POSITION
6001 ONTICK.25,5800
6002 DISPLAY (3,0),"SAFETIES ON"
6010 LINE 116,ON:REM OPEN THE BLADE
6013 D1=2:GOSUB 7000
6030 V0=V1:$(2)="V1500":REM MOVE IN
6031 GOSUB 7500:GOSUB 9200
6035 D1=1*ABS((V4-V0)/1000):GOSUB 7000:V4=V0:PRINT "IN 1",D1
6050 LINE112,ON
6051 D1=1.0:GOSUB 7000
6052 LINE113,ON
6060 D1=2.0:GOSUB 7000
6080 LINE112,OFF:LINE113,OFF:DISPLAY (3,0),"CUT 1",$(1)
6130 D1=0.9:GOSUB 7000
6140 V0=(V1+3000):$(2)="V1000"
6150 GOSUB 7500:GOSUB 9200
6160 D1=0.7:GOSUB 7000:V4=V0:PRINT "OUT 1",D1
6170 LINE116,OFF
6220 LINE 108,ON:REM FIRE 1ST CYL
6240 D1=2.5:GOSUB 7000
6250 V0=V1:$(2)="V1500":REM MOVE BACK IN TO SAME DIMENSION
6260 GOSUB 7500:GOSUB 9200
6270 D1=1*ABS((V4-V0)/1000):GOSUB 7000 :V4=V0:PRINT "IN 2",D1
6290 LINE112,ON:LINE116,ON:REM START CUT 2
6291 D1=1.0:GOSUB 7000
6292 LINE113,ON
6310 D1=2.0:GOSUB 7000
6330 LINE112,OFF I LINE113,OFF:DISPLAY (3,0),"CUT 2",$(1)
6370 D1=0.9:GOSUB 7000
6380 V0=(V1+2000):$(2)="V1000"
6390 GOSUB 7500:GOSUB 9200
6400 D1=0.7:GOSUB 7000:V4=V0:PRINT "OUT 2 START", D1
6460 LINE109,ON :d1=0.5:gosub 7000:LINE108,OFF
6470 D1=1*ABS((V4-V0)/1000):GOSUB 7000:V4=V0:PRINT "OUT 2 END", D
6475 LINE116,OFF
6480 V0=V2:$(2)="V1500":REM MOVE IN
6490 GOSUB 7500:GOSUB 9200
6500 D1=1*ABS((V4-V0)/1000):GOSUB 7000:V4=V0:PRINT "IN 3",D1
6520 LINE112,ON:LINE116,ON:REM START CUT 3
6521 D1=1.0:GOSUB 7000
6522 LINE113,ON
6540 D1=2.0:GOSUB 7000
6550 LINE112,OFF:LINE113,OFF:DISPLAY (3,0),"CUT 3",$(1)
6600 D1=2:GOSUB 7000
6605 LINE116,OFF
6610 LINE110,OFF:REM CHUTE UP
6620 D1=1:GOSUB 7000
6680 LINE111,OFF:DISPLAY (3,0),"DROP"
6685 LINE108,ON:LINE109,OFF
6690 V0=V3:$(2)="V1000":REM MOVE TO SET
6700 GOSUB 7500:GOSUB 9200
6706 LINE108,OFF
6710 D1=1:GOSUB 7000:V4=V0
6720 GOSUB 5200:REM I/O OFF
6730 LINE113,ON:LINE116,ON:REM CLOSE BLADE
6780 D1=2:GOSUB 7000
6785 ONTICK O, 5800
6786 DISPLAY (3,0), "READY"
6787 CLEAR KEYPAD
6790 LINE116, OFF
6800 GOSUB 5200
6999 RETURN
7000 REM SUB DELAY
7001 CLEAR TICK(0)
7002 T1=0
7010 DO
7015 T1=TICK(0)
7020 WHILE T1<D1
7045 RETURN
7500 REM INTEGER TO STRING ASSUMES V0 RETURNS $(1)
7501
7505 ASC($(1),1)=ASC(M)
7510 ASC($(1),2)=INT(V0/10000)+48
7511 N1=INT(V0/10000)*10
7520 ASC($(1),3)=(INT(V0/1000)-N1)+48
7521 N1=INT(V0/1000)*10
7530 ASC($(1),4)=(INT(V0/100)-N1)+48
7531 N1=INT(V0/100)*10
7540 ASC($(1),5)=(INT(V0/10)-N1)+48
7541 N1=INT(V0/10)*10
7550 ASC($(1),6)=(INT(V0)-N1)+48
7599 RETURN
8500 REM MOTOR SETUP
8530 CLEAR COM(1)
8535 $(0)="I1":GOSUB 9500
8540 $(0)="V1500":GOSUB 9500
8550 $(0)="F0":GOSUB 9500
8560 $(0)="M-8000":GOSUB 9500
8561 D1=5:GOSUB 7000
8562 $(0)="V500":GOSUB 9500
8563 $(0)="M400":GOSUB 9500
8564 D1=1:GOSUB 7000
8570 $(0)="M-1000":GOSUB 9500
8571 D1=1:GOSUB 7000
8575 $(0)="I0":GOSUB 9500
8576 $(0)="L0":GOSUB 9500
8580 RETURN
9200 REM MOTOR MOVE
9210 RLN=0
9220 CLN=0
9230 RETCOD=0
9270 CLEAR COM(1)
9280 $(0)=$(2):GOSUB 9500
```

```
9300 $(0)=$(1):GOSUB 9500
9310
9400 RETURN
9500 REM SUB TO SEND COMMAND TO M100
9505 IZ=1:AZ=0
9510 DO
9515 AZ1=ASC($(0), IZ)
9520 IF AZ1<>13 THEN AZ=AZ+AZ1:IZ=IZ+1
9525 WHILE AZ1<>13
9530 CLN=IZ+2
9535 AZ=AZ+DEVS+DEVS
9540 AZ=AZ.AND. 127
9545 UO 1
9550 CLEAR COM(1)
9555 PRINT CHR(DEVS),$(0),CHR(DEVS),CHR(AZ),
9560 UO 0
9599 RETURN
9600 REM KEYPAD ENTRY
9610 P=1:PF=0:L=0:DP=0:R1=1
9615 V1=0:V2=0:V3=0:V4=0
9620 DISPLAY (0,0):CLEAR DISPLAY LINE
9625 DISPLAY (1,0):CLEAR DISPLAY LINE
9630 DISPLAY (2,0):CLEAR DISPLAY LINE
9635 DISPLAY (3,0):CLEAR DISPLAY LINE
9640 DISPLAY (3,0),$(11),(L,9), "HEIGHT"
9645 DISPLAY CR
9650 DO
9655 GOSUB 9750
9660 WHILE PF=0
9665 P=1:PF=0:L=1:DP=0:R1=1
9670 DISPLAY (3,0),$(11),(L,9),"WIDTH"
9675 DISPLAY CR
9680 DO
9685 GOSUB 9750
9690 WHILE PF=0
9695 P=1:PF=0:L=2:DP=0:R1=1
9700 DISPLAY (3,0),$(11),(L,9), "CENTERLINE"
9705 DISPLAY CR
9710 DO
9715 GOSUB 9750
9720 WHILE PF=0
9725 GOSUB 5500
9740 PRINT "V1",V1,"V2",V2,"V3",V3
9745 RETURN
9750 REM START LOOP
9755 A=KEYPAD(0)
9760 IF A=0 THEN 9750
9765 IF A=12 THEN 9815
9770 IF A=16THEN9840
9775 IF A=13 THEN DP=P
9780 A=ASC($(10),A)
9785 ASC($(12),P)=A
9795 P=P+1
9800 ASC($(12),P)=13:DP=0
9805 DISPLAY (L,0), $(12)
9810 RETURN
9815 $(12)=" "
9820 P=1
9825 DISPLAY (L,0),
9830 DISPLAY CR
9835 GOTO 9750
9840 REM SET PUSHED
9845 R1=0
9850 GOSUB 9870
9855 IF R1=1 THEN P=1:PF=1 RETURN
9860 $(12)=" " :P=1:DISPLAY (L,0), " ":DISPLAY CR
9865 GOTO9750
9870 V4=0
9875 IF DP=0 THEN M=P-1 ELSE M=DP-1
9880 PRINT "P DP M", P,DP,M,
9885 IF M=2 THEN V4=(ASC($(12),1)-48)*10+(ASC($
  (12),2)-48)
9890 IF M=1 THEN V4=(ASC($(12),1)-48)
9895 IF DP>0 AND. (P-DP)>1 THEN GOTO 9905
9900 GOTO 9930
9905 M1=0.1
9910 FOR J=DP+1 TO P-1
9915 V4=V4+(ASC($(12),J)-48)*M1
9920 M1=M1/10
9925 NEXT
9930 PRINT "V4",V4,"L",L
9935 IF L=0 THEN GOTO 9950
9940 IF L=1 THEN GOTO 9958
9945 IF L=2 THEN GOTO 9960
9950 V1=V4
9955 IF V1>5 AND. V1<11.1 THEN GOTO 9970 ELSE
  GOTO 9980
9958 V2=V4
9959 IF V2>4.5 AND. V2<11.1 THEN GOTO 9970 ELSE
  GOTO 9980
9960 V3=V4
9965 IF V3>3.5 AND. V3<7 THEN GOTO 9970 ELSE
  GOTO 9980
9970 DISPLAY (3,0), "OUT OF RANGE"
9975 R1=0
9980 PRINT V1,V2,V3,V4
9999 RETURN
```

Those skilled in the art will recognize that the above code is merely a currently preferred example of how the control system CS may be programmed. However, it will be understood that if different controllers or different computer languages are used, or if a different programmer is consulted, entirely different code may be written to carry out the present invention.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A book trimmer (1) for trimming the margins of a perfect bound book (B), said book having a plurality of text pages (P) and a cover (C), said book being generally rectangular and having two minor edges and two major edges, said text pages being bound to said cover along one of said major edges constituting the spine (S) of said book, said book to be trimmed along its minor edges and along the other of its major edges opposite said spine to said predetermined finished dimensions, said trimmer comprising a platen (19) and a trimming blade (15) cooperable with said platen, said blade being movable in a shear plane (SP) with respect to said platen between an open position in which the book may be inserted between said blade and said platen and a closed position in which the book is sheared between said blade and said platen, a holder (35) for gripping said book, a carriage (23) supporting said holder, a sub-frame (27) on which said carriage is mounted, said sub-frame along with said carriage and said holder being movable toward and away from said shearing plane, said holder and said book being rotatable relative to said carriage between a first holder position, a second holder position, and a third holder position where said holder positions are substantially 90 degrees from one another, said carriage being movable in transverse direction with respect to said sub-frame between a first carriage position in which said holder is in said first holder position, a second carriage position in which said holder is in said second holder position, and a third carriage position in which said holder is in said third holder position whereby with said holder in said first holder position and with said carriage in said first carriage position said book is positioned relative to said shearing plane such that actuation of said blade shears a predetermined amount of the margin of said book along a first edge of said book, with said holder in said second position and with said carriage in said second carriage position said book is positioned relative to said shearing plane such that actuation of said blade shears a predetermined amount of the margin of said book along a second edge, and with said holder in said third holder position and with said carriage in said second carriage position said book is positioned relative to said shearing plane such that actuation of said blade shears a predetermined amount of the margin of said book along a third edge thereby to produce a finished book trimmed to said predetermined finished dimensions.

2. A book trimmer as set forth in claim 1 wherein said book is oriented in a substantially vertical plane, and wherein said shearing plane is substantially horizontal.

3. A book trimmer as set forth in claim 2, wherein with said holder positioned so as to dispose one edge of said book parallel to said shearing plane and with said sub-frame positioned so that said one edge of said book resting rests on said blade, a reference position is established.

4. A book trimmer as set forth in claim 3 wherein with said holder gripping said book proximate said spine substantially equidistantly between said minor edges, said sub-frame moving said book relative to said reference position so as to position said first edge of said book relative to said shearing plane such that a predetermined amount will be trimmed from said book along said one edge upon actuation of said blade.

5. A book trimmer as set forth in claim 4 wherein said holder is rotatable with respect to said carriage such that said book is rotated approximately 180° as said carriage moves from its first to its second position thereby to orient said second edge relative to said shearing plane for trimming said second edge, and wherein said holder is rotatable approximately 90° with respect to said carriage as said carriage moves from its second to its third position thereby to orient said third edge relative to said blade for trimming said third edge.

6. A book trimmer as set forth in claim 5 wherein said third position is intermediate said first and second positions.

7. A book trimmer as set forth in claim 5 further wherein said trimmer further comprises an actuator for raising and lowering said sub-frame relative to said shearing plane so as to position said edges of said book relative to said shearing plane such that upon actuation of said shearing blade said blade shears said predetermine amounts from said book.

8. A book trimmer as set forth in claim 1 further comprising a controller for controlling operation of said sub-frame as the latter moves between its said positions, for controlling said holder as the latter grips said book, for controlling operation of said carriage to move toward and away from said shearing plane, and for controlling operation of said blade.

9. A book trimmer as set forth in claim 8 wherein said finished dimensions of said book are known to said controller such that with said book in said first, second and third positions, said controller determines the amount of said book along said first, second and third edges to be trimmed so as to result in said finished book of said finished dimensions.

10. A book trimmer for trimming the edges of a perfect bound book, the latter comprising a plurality of text pages and a cover, said book being rectangular and having major and minor edges, said book to be trimmed along two of its minor edges and along one of its major edges to predetermined finished dimensions, the other of the major edge of said book constituting a spine along which said text pages are bound to said cover, said trimmer comprising a trimming blade movable between an open position in which said book may be inserted between the blade and a blade platen and a closed position in which said book is sheared between said blade and said platen along a shearing plan, a holder for gripping said book as said book is trimmed, a carriage supporting said holder, said carriage being movable laterally with respect to said blade between a first position in which a first edgs of said book may be trimmed, a second position in which a second edge of said book may be trimmed, and a third position in which a third edge of said book may be trimmed, an indexing mechanism for shifting said carriage between its said first, second and third positions, said carriage along with said holder being movable toward and away from said blade so as to position said book with respect to said blade such that said with said carriage in its said first, second and third positions, said first, second and third edges of said book are positioned with respect to said shearing plane such that predetermined amounts of said book may be trimmed from said first, second and third edges thereby to produce a book trimmed to its predetermined finished dimensions.

11. A book trimmer as set forth in claim 10 wherein said book is oriented in a substantially vertical plane as said first, second and third edges are trimmed, wherein said blade moves substantially horizontally as said first, second and third edges are trimmed, and wherein with said blade in its closed position and with one edge of said book engaging said blade thereby to establish a reference position for said book with respect to said shearing plane.

12. A book trimmer as set forth in claim 11 wherein with said one edge of said book resting on said blade in said reference position, said holder gripping said book between said first and second edges proximate said spine.

13. A book trimmer as set forth in claim 12 further comprising a sub-frame carrying said carriage, said sub-frame being movable toward and away from said shear plane, wherein with said holder gripping said book between said first and second edges and with said blade in its open position, said sub-frame moving said book relative to said shearing plane so as to position said first edge of said book such that a predetermined amount will be trimmed from said book along said shearing plane upon actuation of said blade.

14. A book trimmer as set forth in claim 13 wherein said holder is rotatable with respect to said carriage such that said book is rotated approximately 180° as said carriage is moved from its first to its second position thereby to orient said second edge relative to said shearing plane for trimming said second edge, and wherein said holder is rotatable approximately 90° with respect to said carriage as said carriage is moved from its second to its third position thereby to orient said third edge relative to said trimming blade for trimming said third edge.

15. A book trimmer as set forth in claim 14 wherein said third position is intermediate said first and second positions, and wherein with said carriage in its said third or intermediate position, said carriage is substantially centered between said first and said second positions.

16. A book trimmer as set forth in claim 14 further comprising an actuator for raising and lowering said sub-frame relative to said shearing plane.

17. A book trimmer as set forth in claim 16 wherein said actuator is actuated when said book is in its said second position thereby to position said second edge of said book relative to said shearing plane such that upon actuation of said shearing blade a predetermined amount of said book along said second edge is trimmed.

18. A book trimmer as set forth in claim 17 wherein said actuator is actuated when said book is in its said third position thereby to position said third edge of said book relative to said shearing plane such that upon actuation of said shearing blade a predetermined amount of said book along said third edge is trimmed.

19. A book trimmer as set forth in claim 15 further comprising a guide engageable with said holder as said holder is moved into its said third or intermediate position thereby to position said one major edge of said book relative to said shearing plane.

20. A book trimmer as set forth in claim 10 wherein said shearing plane is a horizontal plane and wherein said book is oriented vertically with respect to said shearing plane, with said trimming blade in its closed position and with said carriage in its said first position, said one minor edge of said book to be trimmed may be abutted against said trimming blade thereby to establish a reference position for the book to be trimmed.

21. A book trimmer as set forth in claim 20 wherein with said blade in its closed position, with said one minor edge of said book in engagement with said blade, and with said holder loosely gripping said book, said carriage along with said holder being movable relative to said book so as to position said holder relative to said book so as to grip said book proximate the spine of said book substantially equidistant between said minor edges of said book.

22. A book trimmer as set forth in claim 21 with said holder gripping said book at said position substantially equidistantly between said minor edges, with said book in the vertical position when said one minor edge was in engagement with said blade, and with said blade in its open position, wherein said sub-frame is moved vertically relative to said horizontal shearing plane of said blade so that said book is positioned relative to shearing plane such that a predetermined amount of said book along said one minor edge is positioned relative to the shear blade for being trimmed from said book upon closing of said shear blade.

23. A book trimmer as set forth in claim 22 wherein prior to actuation of said shear blade with said book in said second position, said sub-frame being moved vertically relative to said horizontal shearing blade so that said book is positioned relative to said shear plane such that a predetermined amount of said book along said one major edge is positioned relative to the shear blade for being from said book upon closing of said shear blade.

24. A book trimmer as set forth in claim 23 wherein prior to actuation of said shear blade with said book in said third position, said sub-frame being moved vertically relative to said horizontal shearing blade so that said book is positioned relative to said shear plane such that a predetermined amount of said book along said one major edge is positioned relative to the shear blade for being trimmed from said book upon closing of said shear blade.

25. A book trimmer as set forth in claim 10 wherein a first stop is positioned relative to said holder for engagement by said carriage as the latter moves into its said first position for positioning said holder in its said first position, a second stop positioned relative to said holder as the latter moves into its said second position for positioning said holder in its said second position, and a third stop positioned relative to said holder for engagement by said holder as the latter moves into its said third position for accurately positioning said holder at said third position.

26. A book trimmer as set forth in claim 10 further comprising a controller for controlling operation of said carriage as the latter moves between its first, second and third position, for controlling said holder as the latter grips said book, for controlling operation of said carriage to move toward and away from said shearing plane, and for controlling operation of said shear blade so as to trim said first, second and third edges of said book.

27. A book trimmer as set forth in claim 25 wherein said predetermined finished dimensions of said book are known to said controller such that with said book in said first, second and third positions, said controller determines the amount of said book along said first, second and third edges to be trimmed so as to result in said finished book of said predetermined finished dimensions.

28. Apparatus for trimming a perfect bound book to a predetermined rectangular size, said perfect bound book having a multiplicity of pages and a cover, said book having first and second minor edges to be trimmed and one major edge to be trimmed, the other major edge of said book constituting a spine along which said pages are bound to said cover, said book before trimming having a major dimension ranging up to a maximum major dimension and said book having a minor dimension ranging up to a maximum minor dimension, said book to be trimmed to predetermined having major and minor finished dimensions, said apparatus having a trimming blade and a blade platen with the blade being movable in horizontal direction relative to said platen between a retracted position in which said book to be trimmed may be inserted between said blade and said platen and a cutting position in which said book is trimmed between said blade and said platen along a horizontal shearing plane, a holder for gripping said book, a carriage carrying said holder movable horizontally relative to said blade between a first position in which a first minor edge of said book is to be trimmed to a second position in which a second minor edge of said book is to be trimmed and a third position in which one major edge of said book is to be trimmed, said carriage being vertically movable with respect to said shearing plane thereby to position said edges relative to said shearing plane such that predetermined amounts of said book along said first and second minor edges and along said one major edge may be trimmed therefrom so as to produce said book or predetermined finished dimensions, and a control system for controlling operation of said holder, said carriage and said shear blade, the finished dimensions of said finished book being known to said control system such that the latter positions said first and second minor edges and said one major edge relative to said shear plane when said carriage is in its first, second and third positions, respectively, so as to trim portions of said book along said first and second minor edges and along said one major edge thereby to result in a trimmed book having said predetermined finished dimensions.

29. Apparatus for trimming a book as set forth in claim 28 wherein with said shear blade in its closed position and with said one minor edge of said book in engagement with said blade thereby to establish a reference position for said book relative to said shearing plane, said carriage along with said holder being movable vertically with respect to said books, said holder gripping said book substantially equidistantly between said minor edges proximate said spine, and wherein with said book held by said holder and with said blade open, said carriage under the control of said controller being vertically movable so as to position said first edge of said book relative to said shearing blade such that upon actuation of said shearing blade a predetermined amount of said book will be sheared therefrom along said first minor edge, said controller effecting movement of said carriage from said first to said second position with said book being rotated about 180° from its said first position such that said second minor edge of said book is disposed to be trimmed by said trimming blade, said controller effecting vertical movement of said carriage relative to said shearing plane as required to effect trimming of a predetermined amount of said book is trimmed from said second minor edge of said book upon actuation of said blade, and said controller effecting movement of said carriage to said third position with said book being rotated about 90° from its second position such that said one major edge of said book is disposed to be trimmed by said trimming blade, said controller effecting vertical movement of said carriage relative to said shearing plane as necessary to effect trimming of a predetermined amount of said book from said one major edge upon actuation of said shear.

30. Apparatus for trimming a book as set forth in claim 29 further having an indexing mechanism for said holder, said indexing mechanism effecting rotation of said holder relative to said carriage through an angle of rotation of approximately 180° as said carriage is moved from its said first to its said second position thereby to position said second edge of said book relative to said trimming blade, and said indexing mechanism further effecting rotation of said holder through an angle of rotation of approximately 90° as said carriage is moved from its said second to its said third position thereby to position said third edge of said book relative to said trimming blade.

31. A book trimming apparatus as set forth in claim 30 wherein said indexing mechanism comprises a crank having an arm pivotally connected to said holder and a linear actuator connected to said carriage movable from a first position in which said carriage is in its said first position to a second position in which said carriage is in its said second position to a third position in which said carriage is in its said third position.

32. Apparatus as set forth in claim 31 wherein said linear actuator comprises a fluid cylinder.

33. Apparatus as set forth in claim 31 having a sub-frame supporting said carriage, said sub-frame having a first stop engageable by said holder thereby to positively locate said holder as the later moves into its said first position, and a second stop carried by said sub-frame engageable by said holder thereby to positively locate said holder as the latter moves into its said second position, and a third stop carried by said sub-frame engageable by said holder as the latter moves into its said third position thereby to positively locate said holder in its said third position.

34. Apparatus as set forth in claim 29 having a sub-frame supporting said carriage, said sub-frame being mounted on guides for vertical movement of said carriage and of said holder toward and away from the horizontal shearing plane of said blade, and an actuator for effecting vertical movement of said sub-frame toward and away from the horizontal shearing plane of said blade thereby to vertically position said edges of said book with respect to said blade such that said predetermined amounts of said book may be accurately trimmed from said first, second and third edges of the book as said carriage and said book carried thereby is in its said first, second and third positions.

35. Apparatus as set forth in claim 34 wherein with said sub-frame in its said first position, said vertical movement actuator is operated to accurately position said first edge of said book relative to said horizontal shearing plane such that said predetermined amount of said book along said first edge is trimmed from the book upon actuation of said shearing blade.

36. Apparatus as set forth in claim 34 wherein with said sub-frame in its said second position, said vertical movement actuator is operated to accurately position said second edge of said book relative to said horizontal shearing plane such that said predetermined amount of said book along said second edge is trimmed from the book upon actuation of said shearing blade.

37. Apparatus as set forth in claim 34 wherein with said sub-frame in its said third position, said vertical movement actuator is operated to accurately position said third edge of said book relative to said horizontal shearing plane such that said predetermined amount of said book along said third edge is trimmed from the book upon actuation of said shearing blade.

38. Apparatus as set forth in claim 34 wherein said shear blade includes a guide for directing said pages of said book to be trimmed into the space between said blade and said platen.

* * * * *